US005087065A

United States Patent [19]

Provence et al.

[11] Patent Number: 5,087,065

[45] Date of Patent: * Feb. 11, 1992

[54] BINDING FOR CONNECTING A SHOE OR BOOT TO A SKI

[75] Inventors: Marc Provence, Thorens Les Glieres; Didier Rousset, Lescheraines; Josiane Dunand, Cran Gevrier, all of France

[73] Assignee: Salomon S.A., Annecy Cedex, France

[ * ] Notice: The portion of the term of this patent subsequent to May 22, 2007 has been disclaimed.

[21] Appl. No.: 378,329

[22] Filed: Jul. 11, 1989

[30] Foreign Application Priority Data

| | | | |
|---|---|---|---|
| Jul. 13, 1988 | [FR] | France | 88 09985 |
| Jul. 21, 1988 | [FR] | France | 88 10157 |
| Jul. 21, 1988 | [FR] | France | 88 10158 |

[51] Int. Cl.[5] ..... A63C 9/086

[52] U.S. Cl. ..... 280/615; 280/631

[58] Field of Search ..... 280/611, 614, 615, 623, 280/626, 631, 632

[56] References Cited

U.S. PATENT DOCUMENTS

| | | | |
|---|---|---|---|
| 4,330,949 | 5/1982 | Kubelka | 280/615 |
| 4,659,103 | 4/1987 | Tessaro | 280/615 |
| 4,682,785 | 7/1987 | Jungkind | 280/615 |
| 4,722,613 | 2/1988 | Jungkind | 280/615 |
| 4,909,532 | 3/1990 | Provence et al. | 280/615 |
| 4,927,168 | 5/1990 | Provence et al. | 280/615 |

FOREIGN PATENT DOCUMENTS

| | | |
|---|---|---|
| 016750 | 10/1980 | European Pat. Off. . |
| 88673 | 2/1983 | European Pat. Off. . |
| 131234 | 10/1985 | European Pat. Off. . |
| 163054 | 12/1985 | European Pat. Off. . |
| 176952 | 4/1986 | European Pat. Off. . |
| 217073 | 8/1986 | European Pat. Off. . |
| 193686 | 9/1986 | European Pat. Off. . |
| 541979 | 11/1973 | Fed. Rep. of Germany . |
| 2537010 | 6/1984 | France . |
| 2582226 | 5/1985 | France . |
| 2565117 | 12/1985 | France . |
| 8503643 | 8/1985 | World Int. Prop. O. . |
| 8505557 | 12/1985 | World Int. Prop. O. . |

*Primary Examiner*—Andres Kashnikow
*Assistant Examiner*—Richard Camby
*Attorney, Agent, or Firm*—Sandler, Greenblum & Bernstein

[57] ABSTRACT

Apparatus for releasably attaching a toe member of a boot to a binding member on the upper surfaces of a ski having a longitudinal median plane includes complementary latching parts on the members which are relatively movable in a longitudinal direction to an operative position at which the latching parts complementarily engage each other. The apparatus further includes a base for mounting on the upper surface of the ski, and an abutment element movably mounted on the base and adapted to engage the toe member of the boot when the members are in operative position. Finally, a resilient element or device acting on the abutment element resiliently maintains the members in operative position.

28 Claims, 15 Drawing Sheets

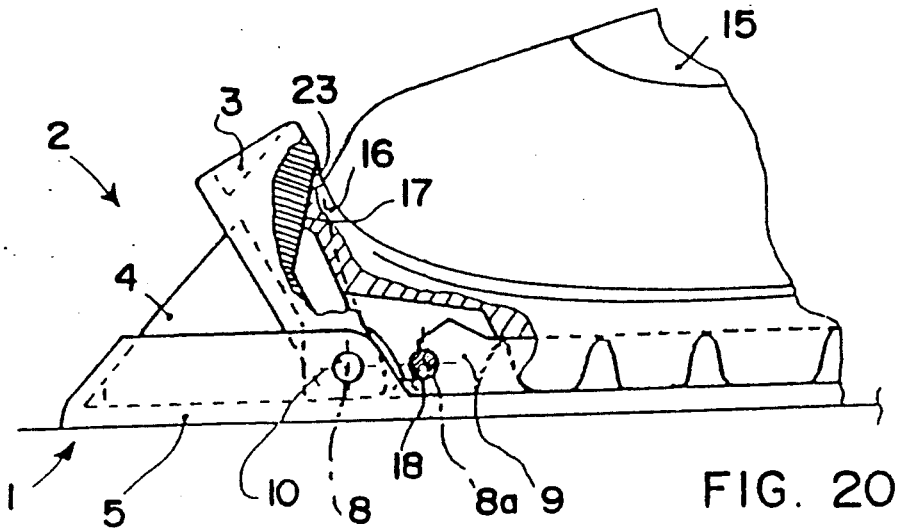
FIG. 20
FIG. 21
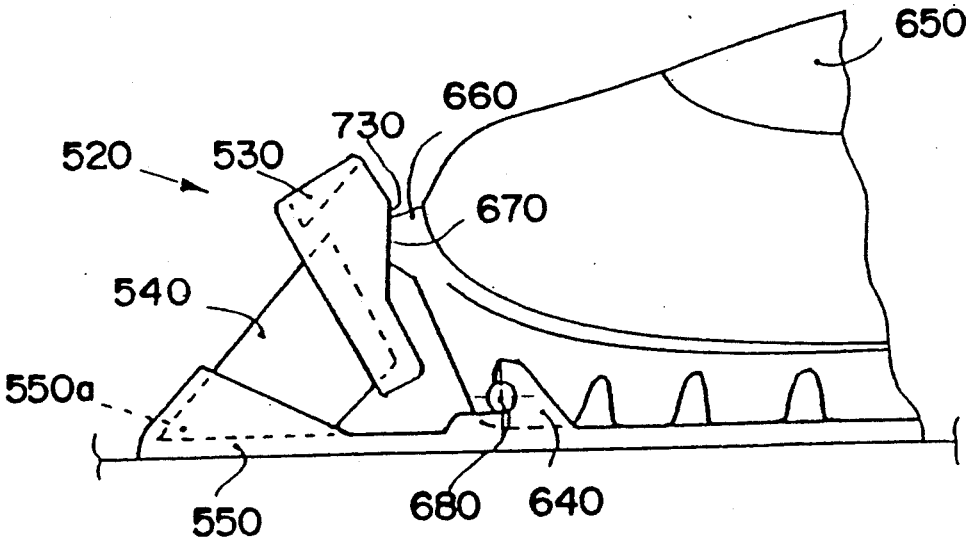

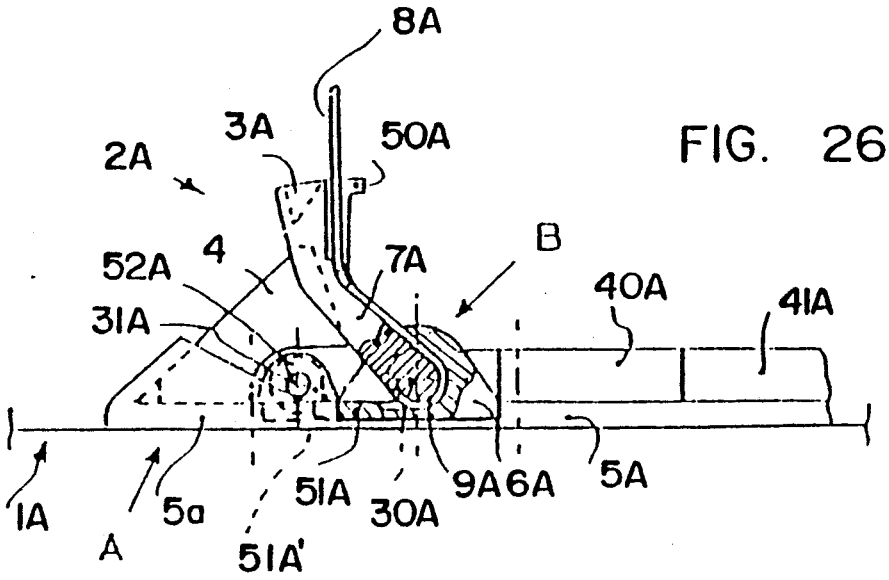
FIG. 26
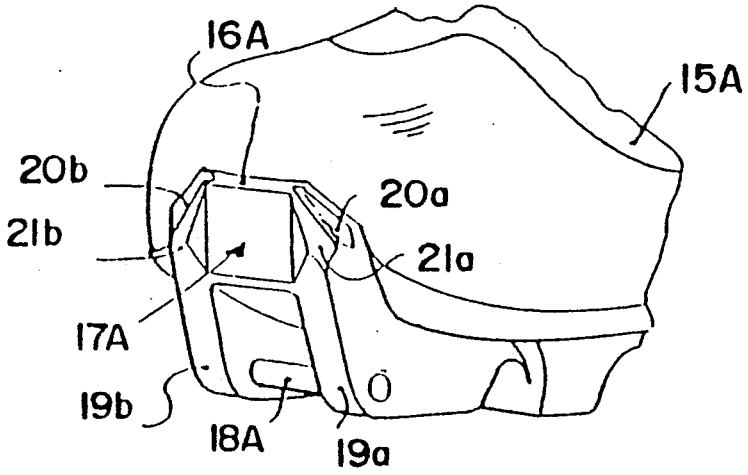
FIG. 27
FIG. 28
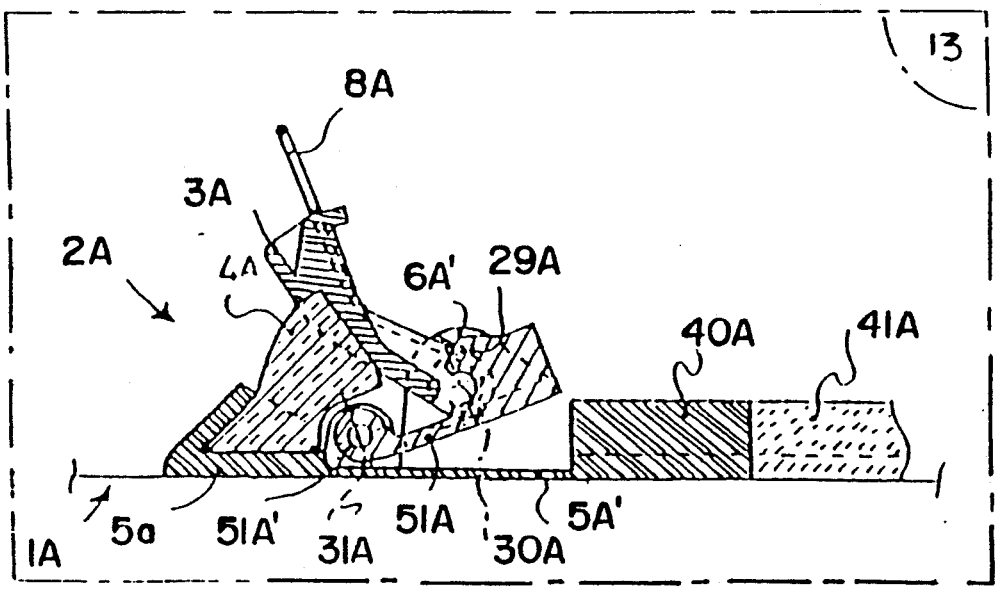

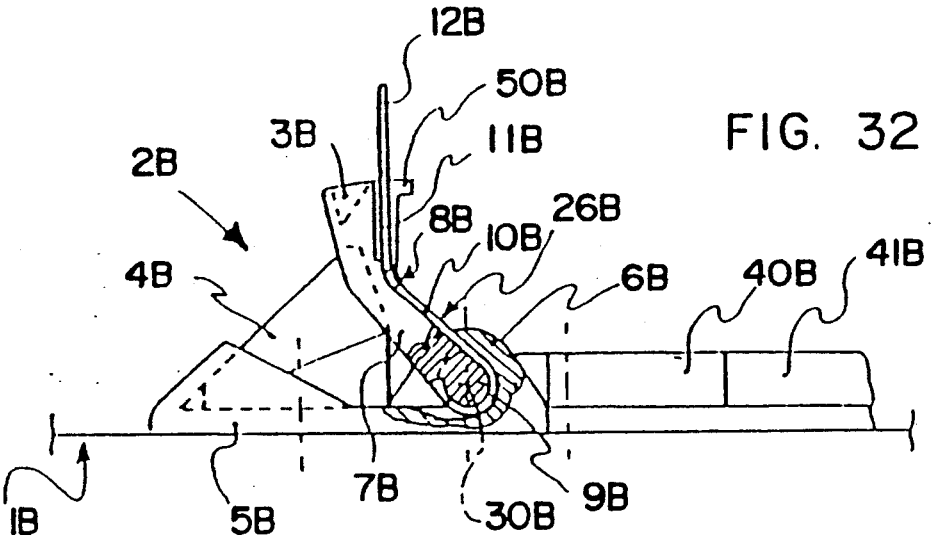
FIG. 32
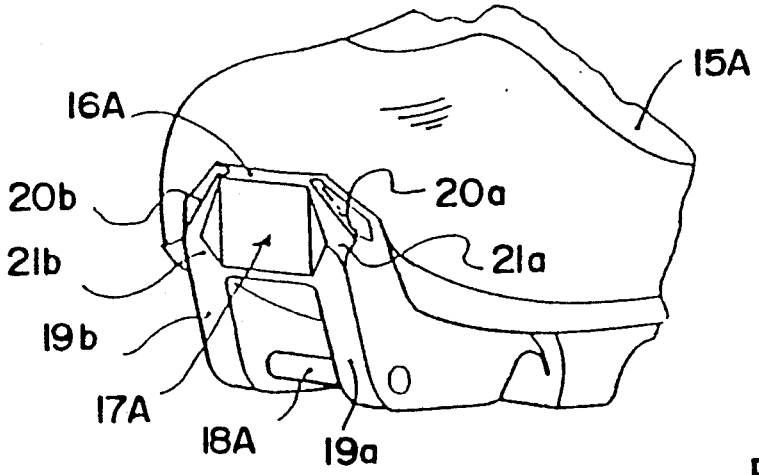
FIG. 33
FIG. 34
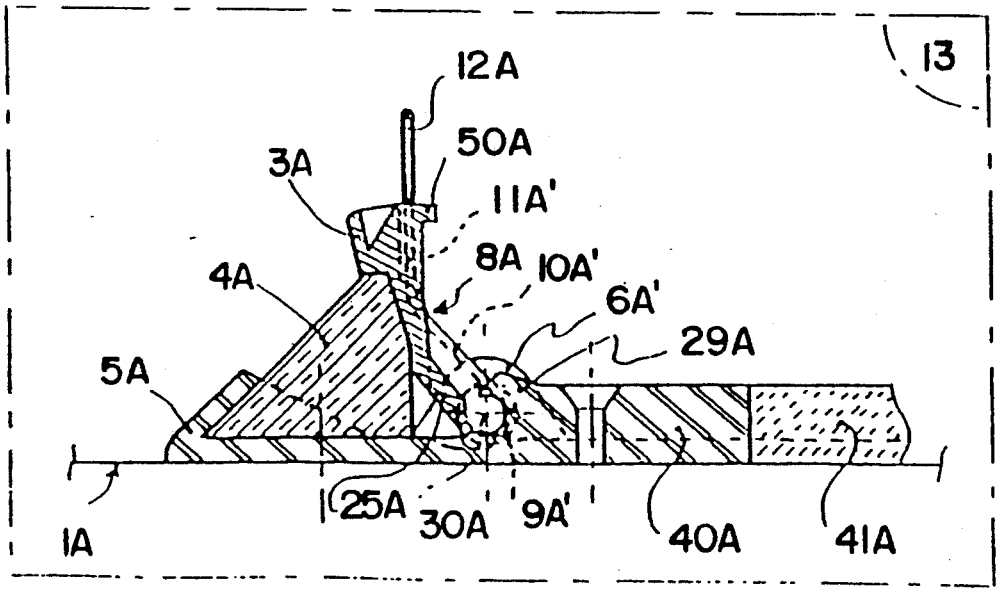

BINDING FOR CONNECTING A SHOE OR BOOT TO A SKI

TECHNICAL FIELD

The present invention relates to a binding for connecting a shoe or boot to a ski. While the apparatus of the invention may be used as a binding for connecting either the front or rear of a boot or shoe to a downhill ski, it is more specifically adapted for connecting only the front of a shoe or boot to a cross-country or mountaineer ski wherein the heel is free to be lifted from the ski.

More particularly, the present invention relates to a binding of the type referred to generally as a hinge-type binding.

RELATED APPLICATIONS

The subject matter of the present invention is related to the subject matter contained in Application Ser. No. 141,846, filed Jan. 11, 1988, now U.S. Pat. No. 4,949,988, issued on Aug. 21, 1990.

BACKGROUND ART

European Patent No. 88,673 discloses a hinge-type binding whose front portion has a latching-shape designed to cooperate with complementary latching means carried by a retention stirrup on the binding. The binding comprises a resiliently hinged latching element designed to allow for automatic positioning of the boot from top to bottom. The retention stirrup is journalled around a transverse axis positioned forwardly of the toe of the boot. This type of binding is advantageous because an intermediate element, namely the retention stirrup, positions the axis of rotation of the boot with respect to the ski beyond the front end of the boot. Most persons familiar with this type of binding know that the increased lifting of the heel by the skier, required as a consequence of the design of the binding, reduces the ability of the user to sense the behavior of the ski, and may result in a reduced ability to control the ski. Furthermore, the forces applied to the journal axis are substantial; this produces play at this point and sometimes results in failure. Furthermore, this intermediate element, by reason of extent of its volume, adds an additional, and not inconsequential, cost to the manufacture of the ski.

European Patent Application No. 131,234 discloses a hinge-type binding in which one element is fixed to the ski, and another element, which is spring-loaded, is longitudinally movable along the ski. The boot comprises two lateral projections which form the axis of rotation of the boot with respect to the ski. In the latched position of the binding, these two projections rest in two faces provided on the fixed element, the movable element covering the two half axes. The return of the heel of the boot to the ski is assured by an elastic means positioned in front of the nose of the shoe or boot. In such apparatus, the energization for latching, and for the return of the boot, are assured by two distinct elastic means which require one of the elements to slide with respect to a fixed element. This system has the disadvantage of being fragile. Furthermore, the relative movement of the two elements causes play during use. As a result, the front of the boot is no longer properly maintained in a lateral direction. Finally, this apparatus is complicated and comprises a substantial number of elements nested one within the other. Its manufacture is thus complicated to the detriment of cost efficiency.

An object of the present invention is to provide a hinge-type binding which is simple and solid, and assures maintaining the proper lateral positioning of the shoe or boot on a ski.

BRIEF DESCRIPTION OF THE INVENTION

According to the present invention, apparatus is provided for releasably attaching a toe member of a boot to a binding member on the upper surface of a ski having a longitudinal median plane. The apparatus includes complementary latching means on the members which are relatively movable in a longitudinal direction to an operative position at which the latching means complimentarily engage each other. The apparatus further includes a base for mounting on the upper surface of the ski, and an abutment element movably mounted on the base and adapted to engage the toe member of the boot when said members are in operative position. Finally, resilient means acting on the abutment element resiliently maintains the members in operative position.

The abutment element is pivotably mounted on the base, preferably about a fixed axis which is parallel to the upper surface of the ski and perpendicular to the median plane. Alternately, the axis may be longitudinally displaceable on the base.

In one embodiment of the invention, the abutment element is U-shaped having a pair of spaced arms connected by a bar, each of the arms being journalled on the base. The free end of the arms may engage the base to limit rearward pivotably movement of the abutment element toward the boot member.

The abutment element cooperatively engages the front support zone of the boot member so as to assure its return to a flat position on the ski as well as to maintain the latching means in operative position.

The insertion of the boot member into the binding member is automatic. The axis of rotation of the boot member with respect to the ski is located in a region substantially directly beneath the toes of the wearer of the boot member. This is a particularly preferred construction when the user is to utilize a skiing technique referred to as a "skating step" because this technique requires, in effect, reduced rotational angles with respect to those which are generally prescribed in the technique of alternating steps. As to this latter technique, an embodiment of the invention is provided in which the rotational axis is positioned in front of the vertical plane directly beneath the front end of the toes.

The nose of the boot member, according to the invention, has a relatively compact shape which is well integrated to the rest of the boot member. As a result, the boot member is well suited for walking.

The apparatus according to the invention comprises a single elastic means to provide for the latching of the boot on the ski, which brings rationalization and an integration to the structure of the apparatus.

The apparatus of the invention is advantageous because the boot comprises a portion which is effective in the latching function by which the boot is attached to a ski, and a portion which is effective in transmitting elastic energy for effecting the latching function, and for effecting a return of the boot to a flat position on the ski. This permits a reduced bias to be used for latching resulting in less wear and tear on the components and thus a longer life.

In another embodiment of the invention, the boot is provided with lateral projections on its toe member adapted to cooperate with sockets in the binding member. The energization system may be similar to that of the first embodiment.

According to another aspect of the invention, the binding can have an intermediate cap journalled with respect to the ski and that finding the axis of rotation of the shoe with respect to the ski, the opening for the transverse shaft of the boot being affixed to the cap and offset towards the rear of the ski with respect to the journal axis of the binding with respect to the ski. The rear portion of the axis of the cap is a bladed inclined from bottom to top resting on an elastic bumper.

According to a further aspect of the invention, the latching means of the boot may have a variable longitudinal cross-section and be associated with complementary latching means possessing the same variation in longitudinal cross-section. These characteristics reduce play in the journalled zone.

According to another aspect of the invention, the rotation axis, about which the abutment element of the binding is pivotable, may be offset with respect to the rotational axis of the boot. This introduces relative movement between the movable abutment element and the frontal support zone of the nose of the boot. This relative movement creates a shock absorption effect on the return moment of the boot to a flat position on the ski because of the friction between the two elements. In addition, an easy compression of the elastic means is achieved when the heel of the boot is lifted from the ski due to the progressive increase in the resistance of said elastic means. These characteristics offer the advantage of substantially reducing external forces on the skier.

In this latter embodiment, the swivel defining the journal axis of the movable abutment element may seat in an elongated slot. As a consequence, the element may slide in the slot thus compensating for lateral play of the boot in the binding.

With respect to the first and third embodiments of the invention, the latching means defines the rotational axis of the shoe or boot with respect to the ski, and may be affixed, not to the shoe, but to the binding and thus to the ski. On the other hand, the complementary latching means, i.e., the axes may be affixed to the boot.

According to another aspect of the invention, the movable support element is connected to the binding only through attachment to an elastic column thus eliminating the need to journal the movable abutment element thus simplifying the system.

As a further modification suitable for use with all of the embodiments described above, apparatus according to the present invention for releasably attaching a boot to a binding may include supplementary, separate, manually operable latching means constructed and arranged to releasably maintain the toe member of the boot in operative position with respect to the boot member. In this manner, involuntary actions that occur during operational use of the ski will not produce sufficient force to effect accidental release of the boot from the binding.

In a preferred embodiment of this aspect of the invention, the manually operable latching means includes an elastic member connected to one of said toe and boot members and selectively engageable with the other said members. Preferably, the elastic member is in the form of a wire having free ends pivotally mounting on said binding member.

Finally, in a modification particularly suitable for an embodiment of the invention utilizing supplemental latching means, when such embodiment is to be used with techniques commonly referred to as "alternate steps" or "skating" in cross-country skiing, the binding includes two subassemblies, one of which is rigidly affixed to the ski, and the other of which is moveable relative to the fixed one. With this arrangement, a double rotation of the boot on the ski about two axes results thereby achieving a better distribution of the forces present when either type of cross-country skiing technique is employed. In this manner, concentrated forces are more evenly distributed, and the force acting on each pivot connection is reduced as compared to an arrangement having only a single pivot axis.

In a preferred embodiment of this aspect of the invention, the base of the binding includes a first subassembly pivotally mounted about a subassembly axis on a second subassembly which is adapted to be fixed to the ski. The abutment element, in this case, is mounted on said first subassembly for pivotal movement about an element axis parallel to the subassembly axis.

BRIEF DESCRIPTION OF THE DRAWINGS

Embodiments of the present invention are shown in the accompanying drawings wherein:

FIG. 20 is a lateral view of a fifth embodiment of the invention;

FIG. 21 is a lateral view of a sixth embodiment of the invention;

FIG. 26 is a side view of a binding according to the present invention, with parts broken away, showing supplemental, manually operable latching means;

FIG. 27 is a perspective view of the front portion of a boot for use with the embodiment of FIG. 26;

FIG. 28 is a longitudinal cross-sectional view of the apparatus shown in FIG. 26 taken along the median longitudinal plane of the ski;

FIG. 32 is a side-view of a binding according to the invention, with parts broken away showing a modification of the binding of FIG. 26;

FIG. 33 is a front-perspective view of a boot designed for the binding of FIG. 26;

FIG. 34 is a cross-section taken along the longitudinal median plane of the apparatus of FIG. 32 showing the subassemblies of this modification in an intermediate position of rotation about a journal axis between the subassemblies;

DETAILED DESCRIPTION

Figure 1:
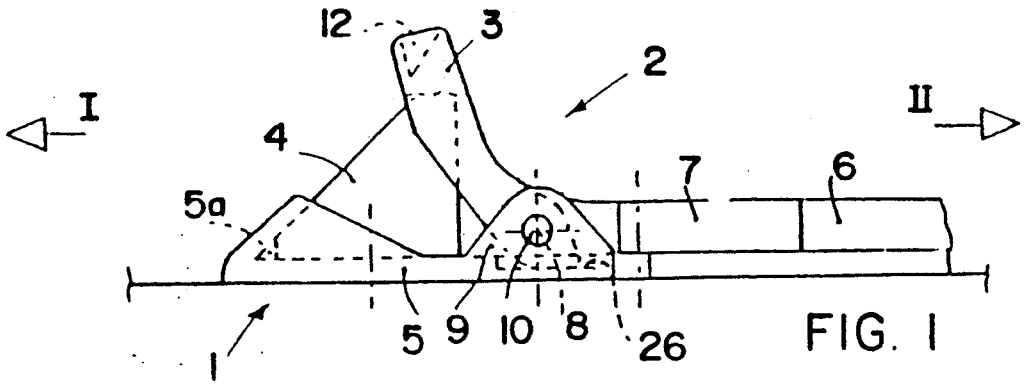
FIG. 1 is a side elevation of a binding of a first embodiment of the present invention.

By convention, the description of the drawings of the present application refers to the front and to the rear of the ski which are designated by respective arrows I and II as shown in FIG. 1. To facilitate further description of the invention, reference will be made to a "boot" but this term is one of convenience, and is intended to cover both ski boots and ski shoes.

Figure 2:
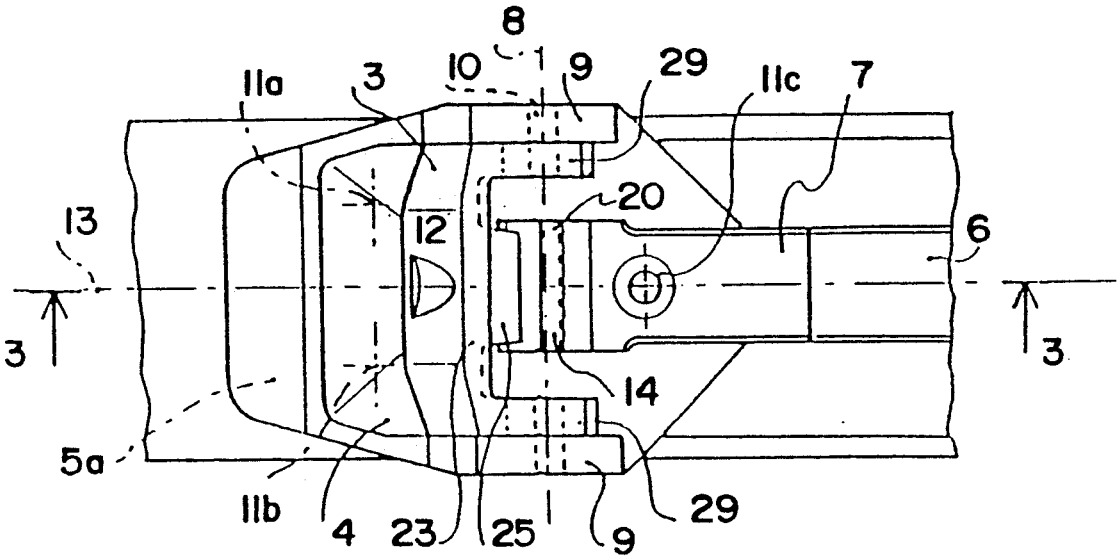
FIG. 2 is a top view of the binding shown in FIG. 1.

Referring now to the first embodiment of the apparatus according to the invention shown in FIGS. 1–7, reference numeral 1 designates a ski which has a top surface on which binding 2 is attached for connecting boot 15 to the ski. The binding may be attached to the ski by screws 11*a*, 11*b* and 11*c*, as shown in FIGS. 1 and 2; but conventional alternate attachment means can be employed. Binding 2 comprises base 5 affixed to the ski, and movable abutment element 3 pivotably mounted with respect to ski 1 on axis 8 by fixed journal means 9 and 10. Base 5 thus includes two laterally spaced flanges 9 that are parallel to the longitudinal median plane 13 of the ski. Each flange 9 is apertured along transverse axis 8 that is perpendicular to longitudinal median plane 13. Fixed in each aperture is pivot shaft 10 which is rotatably mounted in respective bores in laterally spaced arms 29 of movable element 3. Each shaft 10, which is cylindrical with a diameter substantially equal to the aperture in flange 9, is press-fitted into the aperture. Other known means can be employed to fix the shafts to the flanges. The diameter of shaft 10 is less than the diameter of the bores in arms 29 of movable element 3 in order to permit free pivotable movement of the element. The axis of shaft 10 and rotational axis 8 of movable element 3 define a common axis.

Movable abutment element 3 is generally a U-shaped stirrup having a pair of laterally spaced arms 29 interconnected by a transverse bar. The lower portions of arms 29 rotatably receive shafts 10 which are fixed to the binding and which form rotational axis 8 of the movable abutment element 3 with respective ski 1. Arms 29 extend towards the front of the ski to form an upper portion composed of rear abutment surface 23 facing the rear of the ski, and front surface 24 facing the front of the ski. Front surface 24 includes an opening that receives a portion of elastic bumper 4 which functions as energization means for binding 2. Rear abutment surface 23 constitutes an energy transmitting surface for transferring energy in bumper 4 to boot 15. Rear abutment surface 23 may be planar as shown in FIGS. 1 and 2, but other configurations are possible.

Movable abutment element 3 includes central projection 25 directed towards the rear of the ski. This projection is defined by a downward continuation of rear abutment surface 23. The longitudinal plane of symmetry of projection 25 is common to longitudinal median plane 13.

Rotational movement of element 3, which is subject to an elastic bias in a direction towards the rear of the ski, is limited by the engagement of the free ends of arms 29 with bumper 26 on base 5. Preferably, the free end of each arm 29 is shaped like a triangle whose apex is a half cylinder whose axis is common to rotational axis 8 of movable element 3. The lower side of the triangular shape at the free end of arm 29 rests flat on portion 27 of base 5 of binding 2 thus establishing a given angular position, also referred to a neutral position, also referred to as a neutral position, for movable abutment, element 3 with respect to the upper surface of the ski. Preferably, this angular position is in the range of 50° to 70° relative to the top surface of the ski.

The top bar of element 3 which interconnects arms 29 is provided with cavity 12 adapted to receive tip 31 of a ski pole (FIG. 7) so as to effect pivotal movement of element 3 during removal of the boot. Cavity 12 is symmetrical about longitudinal median plane 13 of the ski. Other appropriate means are obviously available to manipulate movable abutment element 3.

Binding 2 according to the invention, includes energization means for assuring both the latching of the boot to the ski and the bias of the boot toward a position in which the sole of the boot is flat on the ski. The energization means is, according to a preferred embodiment of the invention, an elastic system constituted by an elastic bumper of "rubber" material, or other appropriate material having the requisite resiliency. Bumper 4, in its neutral or unstressed state, is substantially triangular in shape as shown in longitudinal cross-section 3—3 (see FIG. 3). One of the surfaces of bumper 4 rests on base 5; and the front corner of the bumper is truncated and fits into space 5*a* formed by an up-turned front edge of base 5. The up-turned edge is inclined rearwardly forming an angle of approximately 40° with the bottom surface of base 5. Lateral side walls at the front end of the base extend towards the rear of the ski to form a cap enclosing the front lower corner of bumper 4. The upper corner of the bumper is truncated in a manner that tightly fits in a corresponding notch in front surface 24 of movable abutment element 3.

FIGS. 2, 3, and 5-7 show latching means 14 on binding 2 and complementary latching means 18 on boot 15 by which the boot is releasably attached to base 5. Latching means 14 on binding 2 is constituted by socket 14 that opens forwardly towards the front of the ski. Socket 14, in the central part of base 5, is transverse to longitudinal median plane 13 of the ski, and its plane of symmetry is common to plane 13. The transverse width of socket 14 is substantially equal to that of transverse shaft or pin 18 on boot 15 (see FIG. 4). Socket 14 is thus a latch that opens towards the front of the ski.

Adjacent the socket is a lower surface which is flat and parallel to the surface of the ski, and which merges in the rear thereof with a tubular conduit having an axial cylindrical surface whose axis is common to axes 8 and 8*a* which are, respectively, the collinear rotational axes of movable abutment element 3, and the axis of pin 18 of boot 15 when the latter is in operative position on the ski. The cylinder is truncated along a vertical plane that is perpendicular to plane 13, the vertical plane being offset towards the front with respect to axes 8 and 8*a* of latching element 14. The result is that socket 14 is essentially a forwardly facing socket having a semicylindrical surface whose axis coincides with the axis of pin 18 on the boot when the latter is in operative position on the binding.

Above socket 14 on the central part of base 5 is ramp 20 whose surface defines a plane that is inclined rearwardly from bottom to top. Ramp 20 operates as a cam in cooperation with pin 18 of boot 15 during automatic insertion of the boot into binding 15. As seen in the drawings, the top of the central part of base 5 at the rear ramp 20 extends downwardly towards the rear of the ski until the top merges with the upper surface of guide edge 7. Such surface lies in a plane parallel to the upper surface of the ski.

As shown in FIGS. 1-3, 4 and 7, guide edge 7 of base 5 has a rectangular cross-section defining a rib that closely fits in corresponding groove 28 in sole 22 of boot 15. Alternatively, guide edge 7 may have any other appropriate shape known to those skilled in the art, the function of the edge being to control lateral displacement of the boot on the ski. As is shown, by way of example only, guide edge 7 is contiguous with guide edge 6 which is on the top of the ski and extends rearwardly from base 5. It is also possible to provide a guide edge forming a single element with the ski, the binding still being positioned in front of this edge. Moreover, the apparatus, according to the invention, may comprise only a single guide edge forming an internal portion with the binding.

Figure 4:
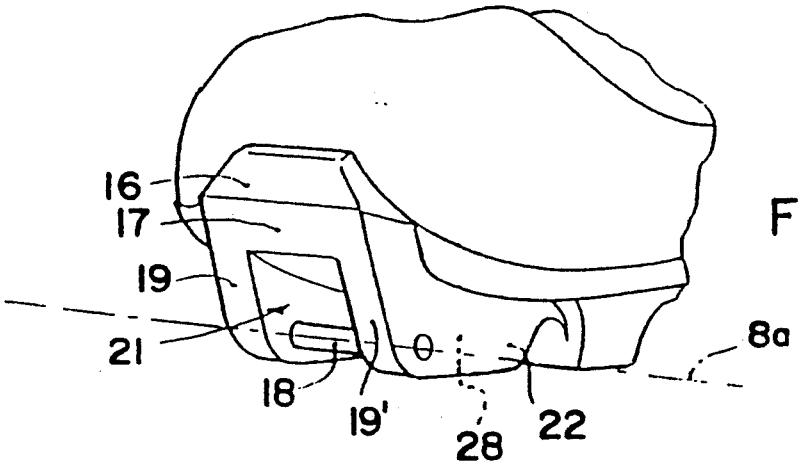
FIG. 4 is a perspective front view of the front end of a shoe or boot according to the first embodiment of the invention.

Another essential element of the apparatus according to the first embodiment of the invention, is boot 15 which is shown partially in FIG. 4. Boot 15 comprises a front end or nose 16 which is shaped like an inverted "U" and defines a pair of laterally spaced symmetrical legs. Nose 16 includes frontal support zone 17 positioned in the upper median transverse portion of the inverted "U", and contacting rear surface 23 of movable abutment 3 when the boot is brought into operative engagement with the binding.

Two lateral edges 19 and 19' of the legs of nose 16 define opening 21 of the nose. Furthermore, edges 19 and 19' are situated in the same plane as frontal support zone 17, i.e., a plane inclined from bottom to top towards the front of the ski thus forming an angle of approximately 70° with respect to the surface of the ski when the sole of boot 15 rests on the ski. The spacing between the lateral edges is such that they fit between arms 29 of movable abutment element 3, and the central part of base 5 contains socket 14.

Figure 3:
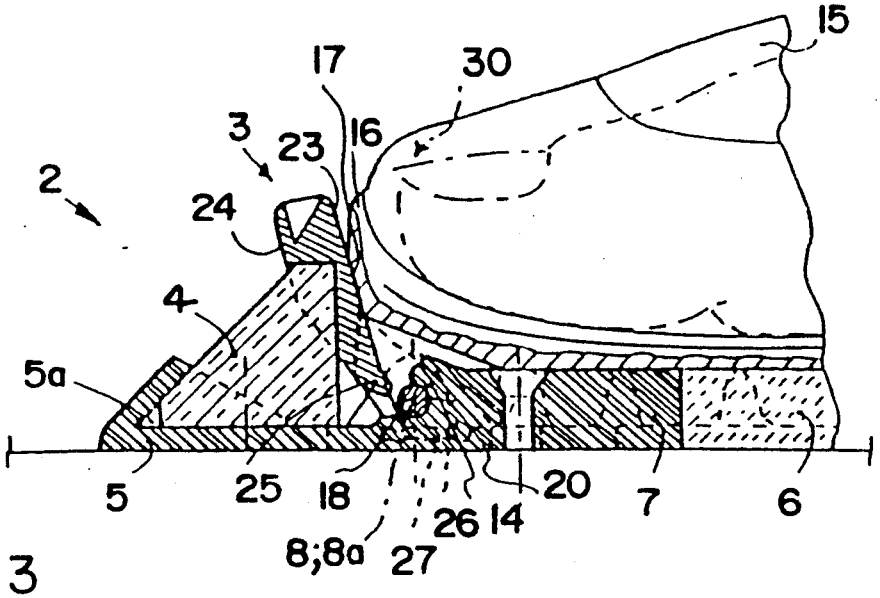
FIG. 3 is a cross-section taken along the line 3—3 of FIG. 2, the boot being shown in a latched, operative position flat on the ski.

FIG. 4 also illustrates another characteristic of the apparatus according to the first embodiment of the invention, namely latching means 18 of boot 15. As described below, latching means 18 is in the form of a transverse pin that cooperates with complementary latching means 14 in the form of a socket. Pin 18 is preferably in the form of metallic cylinder having axis 8*a*. When the boot is in operative position on the ski, pin 18 seats in socket 15. As a consequence, axis 8*a* is coincident with axis 8 of movable abutment element 3 as can be seen in FIG. 3. Axis 8*a* of pin 18 thus forms the axis of rotation of boot 15 with respect to the ski.

Metal is the preferred material of construction of pin 18 because it has the properties of solidity and rigidity necessary for pin 18 to fulfill its function. Other materials might be used, however, depending on circumstances. Pin 18 is solidly fixed by its two axial ends to lateral edges 19 and 19' defining opening 21. In the operative position of the boot on the ski shown in FIG. 3, axis 8*a* of pin 18 is perpendicular to the longitudinal median plane 13 and parallel to the upper surface of ski 1. The rear of opening 21, which constitutes the free central space between the arms of the inverted "U", is defined by a surface that extends downwardly from the front of the boot, from top to bottom, until it reaches the upper surface of groove 28 of sole 22 of boot 15. The width of groove 22 is slightly greater than the width of guidance edges 6 and 7 over which groove 22 fits.

FIG. 3 shows a longitudinal cross-section along 3—3 of the apparatus according to the first embodiment of the invention. Boot 15 is shown resting with its sole flat on the ski; and the boot is shown latched in binding 2. Thus, pin 18 of boot 15 is maintained in operative engagement with socket 14 under the elastic bias imposed on movable abutment element 3 by bumper 4. Element 3 exerts a torque on boot 13 centered on axis 8, 8*a* and directed towards the rear of the ski (clockwise as seen in FIG. 3). This torque arises because of the contact between abutment surface 23 of movable element 3 and frontal support zone 17 of nose 16 of boot 15. Pin 18 is thus biased into engagement with socket 14.

Projection or beak 25 of element 3, which is directed towards the rear of the ski, ensures retention of pin 18 in socket 14 against a possible bias directed from rear to front of boot 15 on binding 2 when the boot is in its operative position. As can be seen in FIG. 3, projection 25 is "superimposed" on pin 18 essentially over its entire length but without actually contacting the pin. This results in some axial play of the boot on the ski, the play having an order of magnitude of 5-10 mm. The function of projection 25 is not to participate directly in the latching of the boot to the binding, but rather to avoid unlatching of boot 15 from binding 2 during the application of substantial force on the boot towards the front of the ski such as occurs during cross-country skiing. On the other hand, projection 25 serves to compensate for consecutive play in lateral biases on the boot.

As seen in the drawings of this embodiment according to the invention, rotational axis 8*a* of boot 15 with respect to the ski is situated substantially directly beneath end 30 of the toes of the user. The arrangement provides a rigid and solid linkage of the boot to the ski in every plane other than the longitudinal median plane 13 which constitutes the plane of rotation of the boot with respect to the ski. This linkage, being close to ends 30 of the toes of the user, imparts to the user a better sensation of the reaction and of the behavior of the ski, particularly when the heel of boot 15 is lifted with respect to the ski, because a skier uses his toes to steer.

The positioning of axis 8*a* below the toes of the user renders binding 2 also well adapted to the "skating" cross-country technique. This is the case because the extended rotation of the boot is limited to an angle in the range of 30°-40°, and because axis 8*a* of rotation is more offset towards the rear of the ski than in conventional binding.

As seen in FIG. 3, latching means 18 of boot 15 cooperates with complementary latching means 14 of binding 2, the latching of the latching means being assured by energization of movable abutment element 3 by elastic bumper 4. The action of bumper 4 is illustrated, schematically, by force F on boot 15 which maintains latching means 18 of the boot and latching means 14 of the binding in operative engagement.

FIG. 3 also shows how boot 15 is connected to the binding by the mutual direct contact between planar zone 23 on element 3 of the binding and planar zone 17 on the boot. FIG. 3 also shows that the lower portions of arms 29 of the movable abutment element captures external surfaces of edges 19 and 19' of nose 16 of the boot thus assisting in maintaining the lateral positioning of the boot in the binding.

Figure 5:
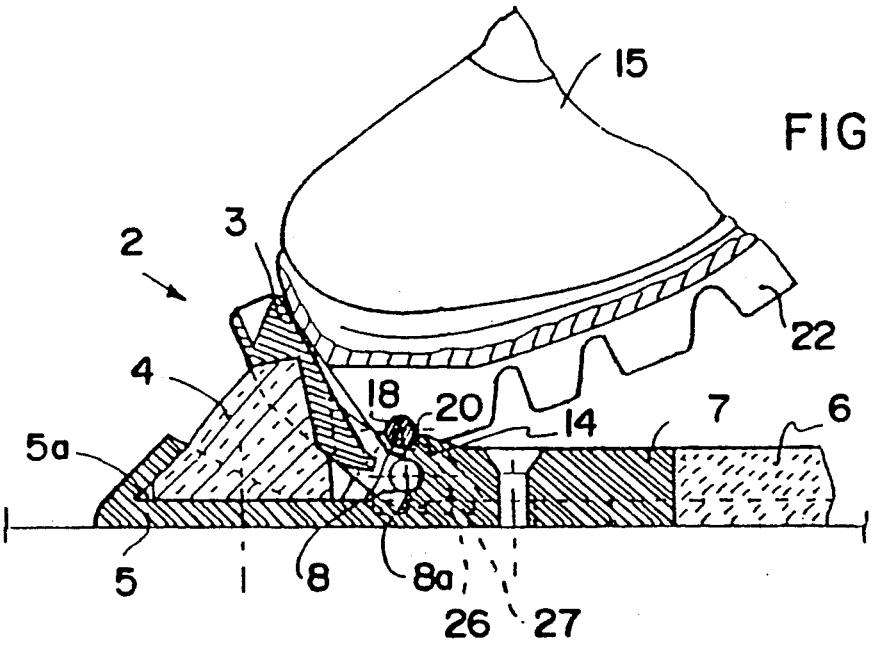
FIG. 5 is a view similar to FIG. 3 showing the first step in the course of automatically inserting the shoe or boot into the binding.

The different operational functions of the apparatus according to the first embodiment of the invention are now described. FIG. 5 illustrates an initial phase of automatic insertion of the boot into binding 2. As described previously, socket 14 of the latching means on the binding opens towards the front of the ski, and ramp 20 above socket 14 functions to guide pin 18 on the boot toward the socket. The skier thus presents his boot to the binding in a manner such that pin 18 on the boot engages ramp 20 as frontal support zone 17 on the boot contacts rear surface 23 of movable abutment element 3. The user then presses his boot forwardly and downwardly causing elastic compression of bumper 4 as element 3 rotates forwardly on shafts 10. Pin 18, having slipped over the lower edge of ramp 20, moves into alignment with socket 14. As this occurs, the boot moves rearwardly as the axis of pin 18 moves longitudinally rearwardly to an operative position at which the pin complementrily engages and seats in socket 14 under the resilient bias exerted by compressed bumper 4. The operational position of the boot on the binding is shown in FIG. 3. Nose 16 of boot 15 is thus latched solidly to binding 2 and the heel of the boot is free to be lifted by the user as pivotable movement of the boot occurs about the axis pin 18.

Figure 6:
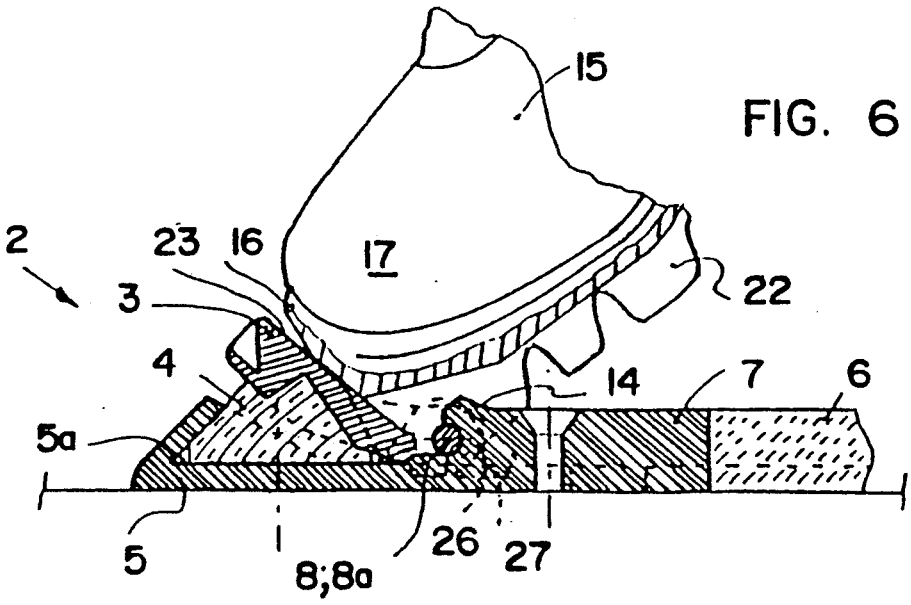
FIG. 6 is a view similar to that of FIG. 3 but showing the boot with its heel lifted.

FIG. 6 shows a phase of the first embodiment of the invention where the heel of boot 15 is lifted from the top surface of the ski. Front end 16 of boot 15 thus pivots about axis 8*a* with respect to the ski. Front support zone 17 of the boot remains engaged without slipping with abutment element 3 during pivotal movement of element 3 from rear to front with respect to the ski along axis 8 which is common to axis 8*a*. That is to say, during this pivotable movement of the boot, no relative movement or slippage occurs between frontal support zone 17 of the boot and rear surface 23 of movable abutment element 3. The consequence of pivotable movement of movable abutment 3 is compression of elastic bumper 4. When the limit of rotation is reached, as established by the compressibility of bumper 4, the energy stored in bumper 4 by reason of its compression is available to restore the boot to its rest position. Consequently, boot 15 is biased by compressed bumper 4 to pivot from front to rear and returned to its rest position flat on the ski as shown in FIG. 3.

Figure 7:
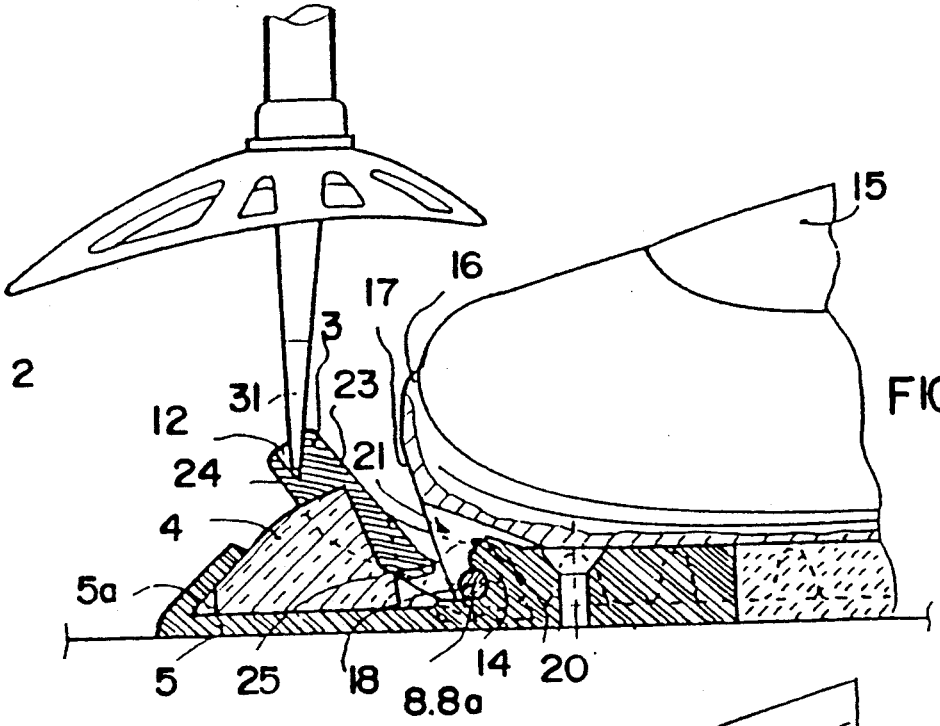
FIG. 7 is a view of the first embodiment similar to FIG. 3 showing the use of a ski pole for removing the shoe or boot.

FIG. 7 illustrates the manipulation required to manually remove boot 15 from binding 2. One applies a vertical force to element 3 by means of tip 31 of a ski pole engaged in support point cavity 12, for example. This force imparts pivotable movement to element 3 in a direction towards the front of the ski against the elastic action of bumper 4. Nose 16 of boot 15 is thus freed from the elastic bias of bumper 4 which is directed towards the rear of the ski. Likewise, projection 25 on element 3 is moved to a retracted position because the projection moves through an arc centered about axis 8 and is thus displaced towards the front of the ski to provide clearance for pin 8. Consequently, pin 8 is no longer blocked by projection 25 in socket 14. Boot 15 can be disengaged from the binding by imparting a slight forward movement of the boot relative to the ski whereby pin 18 is disengaged from socket 14. Subsequent upward movement of the boot by the wearer effects disconnection of the boot from the binding.

Figure 8:
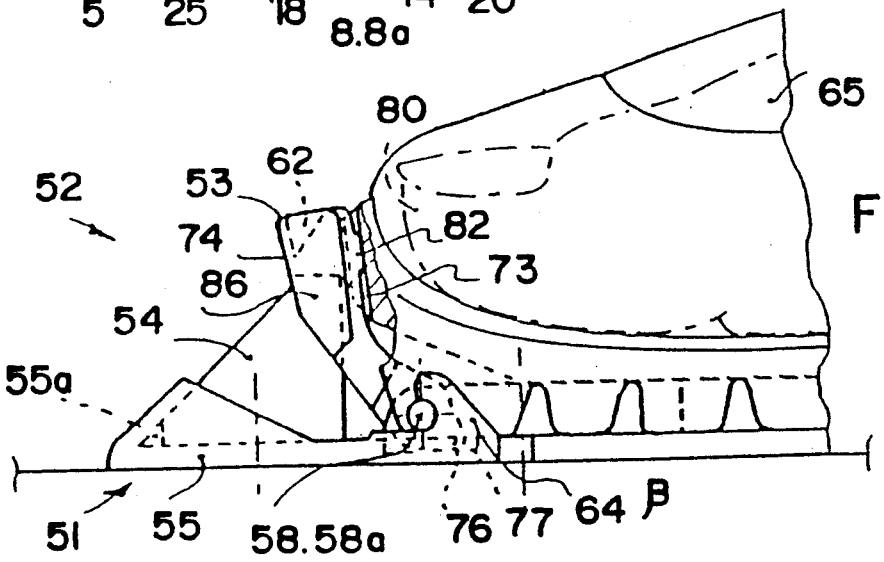
FIG. 8 is a side view of a second embodiment of the invention with a portion of the nose of the boot broken away.
Figure 9:
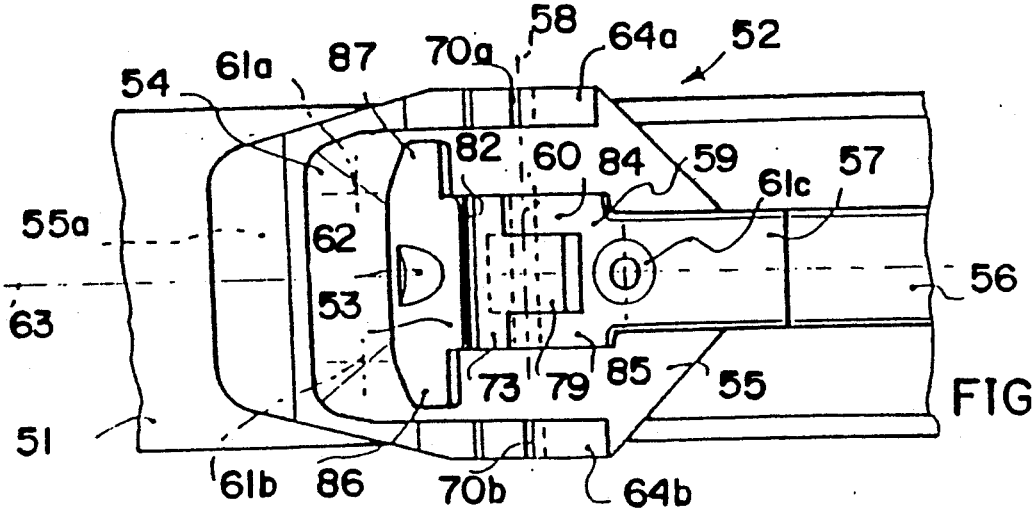
FIG. 9 is a top view of the binding according to FIG. 8.
Figure 10:
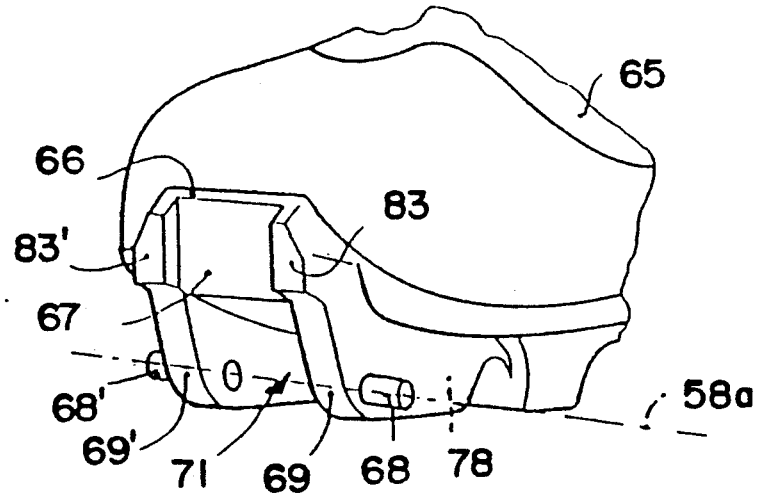
FIG. 10 is a front perspective view of the front end of the boot according to the second embodiment of the invention.

FIGS. 8, 9, and 10 illustrate a second embodiment of the apparatus according to the invention. As shown in FIG. 9, base 55 of binding 52 comprises lateral latching means 64*a* and 64*b*, central mounting 59 in which pivot pin 60 is mounted to provide a fixed journal with respect to ski 51 for movable abutment element 53, seat 55*a* for receiving elastic bumper 54, and guide edge 57 aligned with central rib 56 on the top of ski 51. Three apertures are provided in base 55 for the passage of mounting screws 61*a*, 61*b* and 61*c* by which the base is attached to the ski. Binding 52 also includes movable abutment element 53 journalled in permanent fashion on transverse axis 58 which is perpendicular to longitudinal median plane 63 of the ski, and parallel to the upper surface of the ski. Movable abutment, element 53 includes, in its lower portion, central arm 79 of a width that fits between two uprights 84 and 85 that are a part of mounting 59. Pivot pin 60 is press fitted into a transverse aperture in arm 79, the pin having a cylindrical shape whose axis is common to axis of rotation 58 of movable abutment element 53. Pin 60 projects from each side of arm 79 and pivotably engages in corresponding apertures in uprights 84 and 85 of mounting 59 to form a single element on base 55. Pin 60 constitutes one example among many possible means known to persons skilled in the art for journalling movable abutment element 53 on the ski.

To limit rotation of movable abutment element 53 about pin 60 toward the rear of the ski, abutment means 76 shown by broken lines in FIG. 8 are provided. Abutment means 76 form an abutment that engages complementary means 77 on element 53 for establishing the neutral position of element 53. Abutment means 76 is constituted by a flattened portion of the base which results from an extension towards the free lower end of arm 79 which is substantially cylindrical. Flattened portion 76 is supported on planar surface 77 parallel to the upper surface of ski 51. Surface 77 is positioned in an opening in base 55 adapted to receive the lower portion of movable abutment 53 which extends forwardly in a direction inclined at about 60° with respect to the upper surface of the ski. This angle is established by the engagement of means 76 and 77 which limit rotation of element 53 towards the rear of the ski.

As shown in FIGS. 8 and 9, the upper portion of movable abutment 53 comprises rear surface 73 and front surface 74. Rear surface 73 comprises a local abutment zone constituted by a fillet projecting toward central boss 82 located on the median portion of element 53. The longitudinal plane of symmetry of this median portion is the longitudinal median plane 63 of the ski.

Movable abutment element 53 further includes transverse protuberances 86 and 87 located forwardly of surface 73 and symmetrical with respect to median plane 63. Cavity 62 is provided in the central portion of element 53 for receiving the tip of a ski pole, for example, to effect removal of the boot in the manner previously described.

In a manner similar to that shown in the first embodiment of the apparatus, front surface 74 of movable abutment element 53 has an opening adapted to receive the upper part of truncated tapered portion of elastic bumper 54. This bumper constitutes an elastic system that serves an energizing means for binding 52.

Latching means 64*a* and 64*b* of binding 52, which are complementary to latching means on boot 65, are shown in FIGS. 8 and 9. Each of latching means 64*a* and 64*b* are in the form of separate, forwardly facing sockets symmetrically disposed relative to the longitudinal median plane 63 of the ski. The rear of each socket defines a semicylinder whose axis is common to axis 58*a* which is the axis of rotation of boot 65 with respect to ski 51. The dimensions of these sockets are such that they act as a rotation support with minimized play for complementary latching means 68 and 68' on boot 65. The upper portion of latching means 64*a* and 64*b* define forwardly facing ramps 70*a* and 70*b* inclined from top to bottom towards the front of the ski, such ramps being adapted to act as cams on lateral projections 68 and 68' of boot 65 in the course of automatic insertion of the boot into the binding.

FIG. 10 illustrates a front perspective view of the front portion of boot 65 according to the second embodiment of the invention. Boot 65 is shown provided with front end or nose 66 which comprises frontal support zone 67 adapted to cooperate with central boss 82 of binding 52. Frontal support zone 67 is substantially rectangular and extends toward the upper portion of nose 66.

Frontal support zone 67 is bordered on each side by projections 83 and 83'. Below these projections, edges 69 and 69' slope downwardly and towards the rear of boot 65 and define opening 71 which extends towards the rear of boot 65 to form groove 78 adapted to cooperate with lateral guide edge 57 of binding 52. Lateral guide edge 56 may be applied to ski 51 as described in connection with the first embodiment.

Edges 69 and 69' support lateral pins or projections 68 and 68' which constitute latching means on the boot complementary to latching means 64*a* and 64*b* on the binding. Preferably, projections 68 and 68' are metallic cylinders affixed in edges 69 and 69', and positioned symmetrically with respect to longitudinal median plane 63. When the boot is in operative position on the binding, projections 68 and 68' are aligned with the sockets formed by latching means 64*a* and 64*b* on the base. Longitudinal movement of the boot relative to the binding will seat the projections in the sockets on the base.

The axis of projection 68 and 68' define axis 58*a* of rotation of boot 65 with respect to the ski. As shown in FIG. 8, when the boot is engaged in binding 52, axis 58*a* is collinear with axis 58 of rotation of movable abutment element 53. As is the case with the first embodiment, axis 58*a* of the apparatus according to the second embodiment of the invention is situated substantially directly beneath end 80 of the toes of the wearer as shown in FIG. 8. Each lateral projection 68 and 68' has a length which is substantially the same as the length of each socket of latching means 64*a* and 64*b*.

The cooperation between boot 65 and binding 52 is now described with reference to FIG. 8. According to the previously described process, automatic insertion of a boot is accomplished by presenting lateral projections 68 and 68' on the boot to ramps 70*a* and 70*b* of latches 64*a* and 64*b* on the binding, and by engaging frontal support zone 67 on the boot with projecting abutment 82 on element 53 of the binding. The user then presses his foot downwardly and towards the front of the ski causing the lateral projections to slip over the edges of ramps 70*a* and 70*b* into alignment with the sockets in means 64*a* and 64*b*. Thereafter, the latching of the boot in binding 52 is achieved as the elastic bias of bumper 54 is directed towards the rear of the ski, urges lateral projection 68 and 68' into the sockets. The partial cutaway of nose 66 on boot 65 defined by edges 69 and 69' limit the engagement of the nose with element 53 to contact between frontal support zone 67 and projection 82. Projections 83 and 83', projecting beyond zone 67, laterally encompass median abutment zone 82 of abutment element 53 thus serving to prevent lateral displacement of the toe of shoe 65.

The operation by which the heel is lifted from the ski and boot is removed from the binding is not further described because the principles involved are identical to those previously described with respect to the first embodiment.

A third embodiment of apparatus according to the invention is shown in FIGS. 11–15 wherein reference numeral 102 represents a binding according to the present invention. Binding 102, which is affixed to ski 101 by three screws 111*a*, 111*b*, and 111*c*, comprises base 105 having a base plate that includes a front lip forming receptacle 105*a* containing an elastic system in the form of bumper 104 comprising portions 104*a*, 104*b*. In its rear portion, the base plate includes guide rib 107 whose plane of symmetry is the longitudinal median plane 113 of the ski. Rib 107 on the base and its complementary guide rib 106 on the ski have been described previously; and no further description is necessary to an understanding of this embodiment of the invention. However, the upper surface of rib 107 has a particular shape in that it slopes upwardly from bottom to top towards the front of the ski, as shown in FIG. 4, and then abruptly turns downwardly in a substantial vertical direction.

Figure 11:
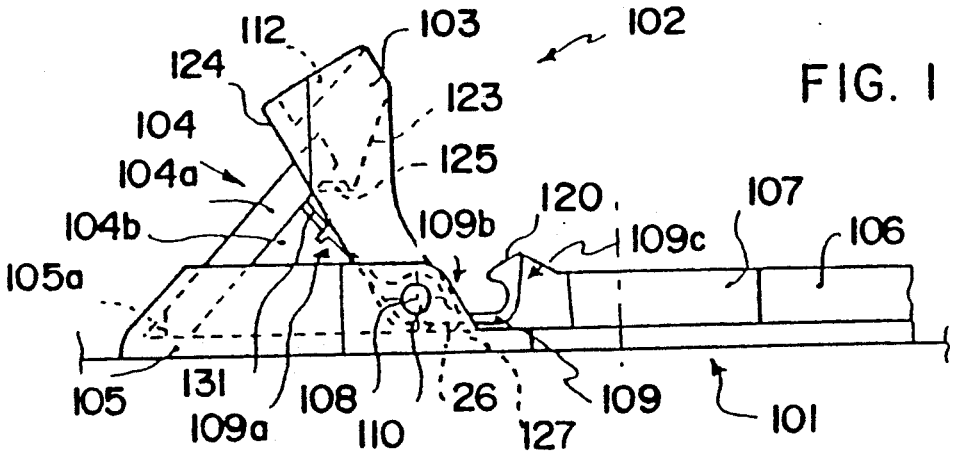
FIG. 11 is a side view of a third embodiment of the invention.
Figure 12:
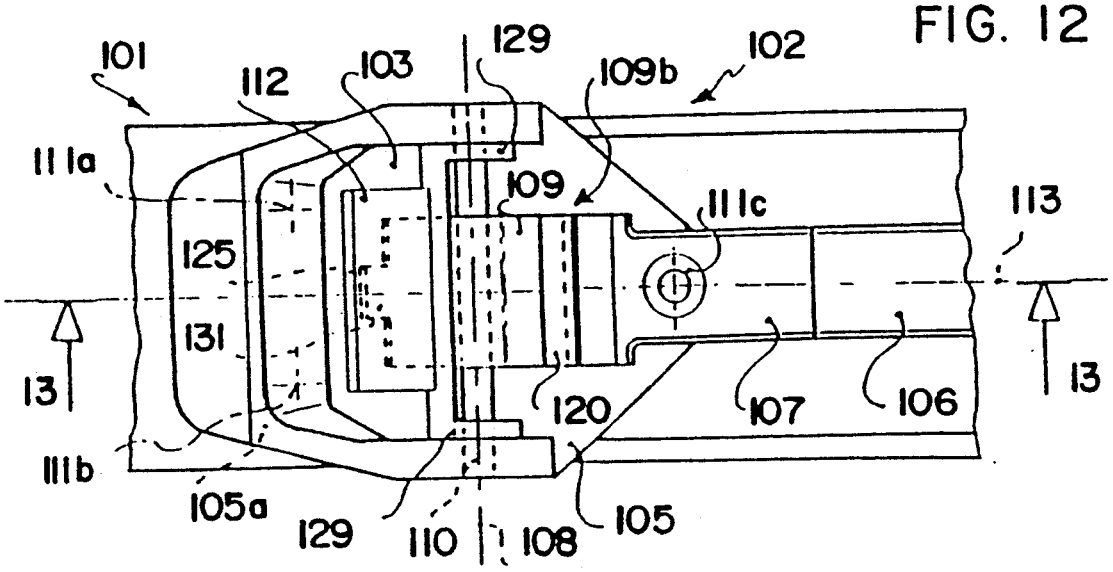
FIG. 12 is a top view of FIG. 11.

Binding 102 also includes movable abutment element 103 which is generally U-shaped and pivotally mounted on the base. Rear surface 123 on the upper median portion of element 103 is inclined from top to bottom towards the front, and faces the rear of the ski. Front surface 124 on the upper median portion of element 103 forms a seat that receives the upper end of portion 104*a* of elastic bumper 104. As shown in FIGS. 11 and 12, rear surface 123 has notch 125 for receiving tongue 131 of intermediate journalled element 109 described below. Finally, cavity 112 may be provided in the top of element 103 to receive the tip of a ski pole for assisting in removal of the boot from the binding as described in connection with the two previously described embodiments.

Each of the free ends of lateral arms 129 of U-shaped element 103 contains a transverse bore that pivotably receives opposite ends of cylindrical metallic element or pivot pin 110 which extends transversely entirely across the width of base 105 The axial ends of pivot pin 110 are press-fitted in the two upturn lateral edges of base 105. Thus, pin 110 defines fixed journal or boot axis 108 about which element 103 is pivotably mounted with respect to ski 101. Axis 108 is perpendicular to the longitudinal median plane 113 and parallel to the surface of ski 101. As a result, axis 108 in this embodiment is common to the axis of pin 110. Other types of pivot connections between element 103 and the base can be employed if desired In a manner similar to the first embodiment of the invention, the free end of each arm 129 on element 103 defines abutment means constituted by flattened portion 126. Such flattened portion is engageable with abutment means 127 on base 105 for limiting rearward rotation of element 103 due to the elastic bias of bumper 104. In its rest or neutral position shown in FIG. 11, element 103 has a predetermined angular position of approximately 50° with respect to the surface of ski 101.

Binding 102 also includes intermediate journalled element 109 whose plane of symmetry is median plan 113 of the ski. Element 109, which preferably is metallic, has an enlarged central hub through which pin 110 passes. The axis of pin 110 also constitutes the rotational axis of journalled element 109 with respect to the ski.

Element 109 includes front portion 109*a* extending forwardly from the hub containing pin 110, and rear portion 109*b* extending rearwardly from the hub, the portions being angularly disposed to each other at an angle of approximately 125°. Portion 109*b* is essentially a plane or plate whose free end terminates in hook 109*c* which contains a forwardly facing socket that constitutes the latching means of the binding. The rear, exterior surface of hook 109*c* mates with the vertical front portion of guide edge 107 when rear portion 109*b* is substantially parallel to the base plate of base 105.

On the upper surface of hook 109*c* is cam 120 which cooperates with transverse shaft 118 on boot 115 (FIG. 15) during an insertion maneuver of the boot described below. As in the first embodiment of the invention, the forwardly open socket in latch 109*c* constitutes the latching means of binding 102 adapted to cooperate with complementary latching means 118 of boot 115.

Front portion 109*a* of element 109 is a plate having tongue 134 projecting from its free edge and inserted into a central space in element 103. In its neutral position shown in FIG. 11, portion 109*a* lies substantially in the same plane as that passing through the two front sides of the arms of element 103, this plane forming an angle with the upper surface of the ski of approximately 50°–55°. Portion 109*a* extends upwardly to a level just below that of the lowest part of the median portion of element 103, except for tongue 131 which is seatable in cutout 125 of the median portion of element 103. Tongue 131 is spaced from cutout 125 when the heel of boot 115 is flat on the ski, but is received in cutout 125 when the heel of boot 115 is lifted, and when the boot is removed from the binding as described below.

The energization means of binding 102 is an elastic system in the form of bumper 104 that comprises portions 104*a* and 104*b*. Bumper 104 is made of "rubber" foam having portion 104*a* engaged in a seat provided for this purpose in front surface 124 of element 103. Portion 104*a* is rectangular in shape. Portion 104*b* of bumper 104, is substantially the same width as intermediate journalled element 109, and is wider than portion 104*a*. Portion 104*b* is embedded between the lateral edges of base 105. Portion 104*b* is triangular when viewed from the side and the bumper is unstressed. The rear surface of portion 104*b* serves to support portion 109*a* of intermediate journalled element 109.

Figure 15:
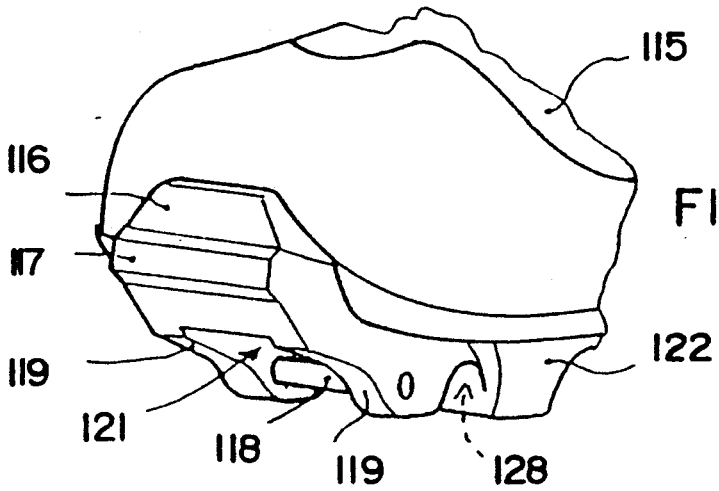
FIG. 15 is front perspective view of the front end of the boot according to the third embodiment of the invention.

FIG. 15 illustrates the front end of a boot according to the third embodiment of the invention. The nose or front end 116 of the boot is provided with front support zone 117 formed by a strip of material projecting beyond nose 116. Such strip has a planar surface that slopes rearwardly from top to bottom. A lower beveled surface connects surface 117 to edges 119 and 119′ defining opening 121 whose lateral spacing is slightly larger than the width of cam 120 that is a part of element 109. The rear of opening 121 is defined by a surface that slopes downwardly to groove 128 in sole 122 of the boot. Groove 128 is complementary in shape to guide ribs 106 and 107 on the ski which cooperate with boot 115 to limit lateral movement of the boot on the ski.

Edges 119 and 119′ support transverse shaft or pin 118 which constitutes the latching means of the boot. Transverse shaft 118 is in the form of a cylinder whose axis, which is termed the boot axis, is transverse or perpendicular to plane 113 and also parallel to the upper surface ski 101 when the boot is in its operative position as shown in FIG. 13 with the latching means of the boot operatively engaged with the latching means on the binding.

Figure 14:
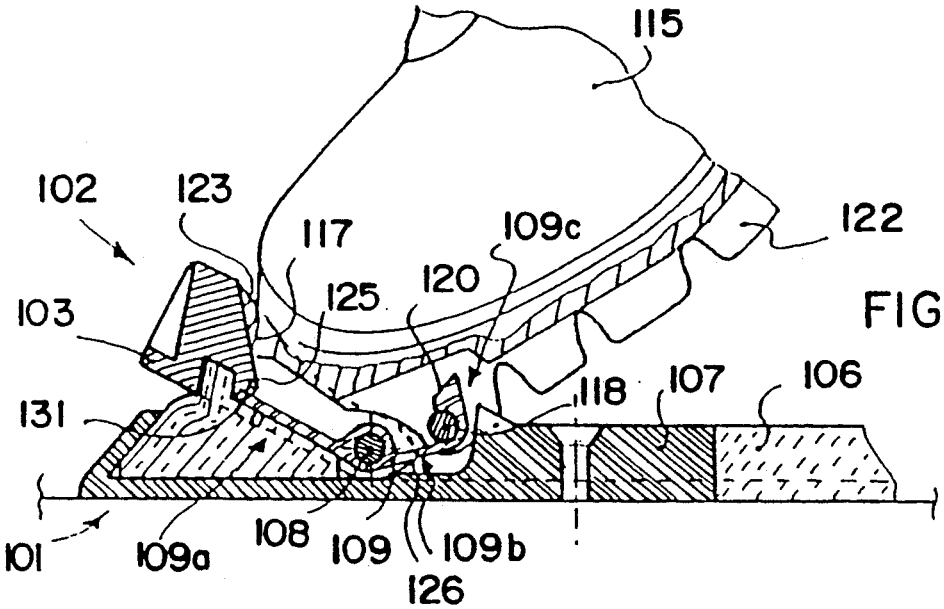
FIG. 14 is a view similar to FIG. 13, but showing the boot in a position with its heel lifted.

As shown in FIG. 14, a vertical plane transverse to median plane 113 and passing through the axis of transverse shaft 118 of boot 115 is offset rearwardly with respect to a vertical plane transverse to median plane 113 and passing through the front end of nose 116. The angular relationship between the upper surface of ski 101 and the plane of inclination of nose 116 of the boot is of the order of about 60°.

Figure 13:
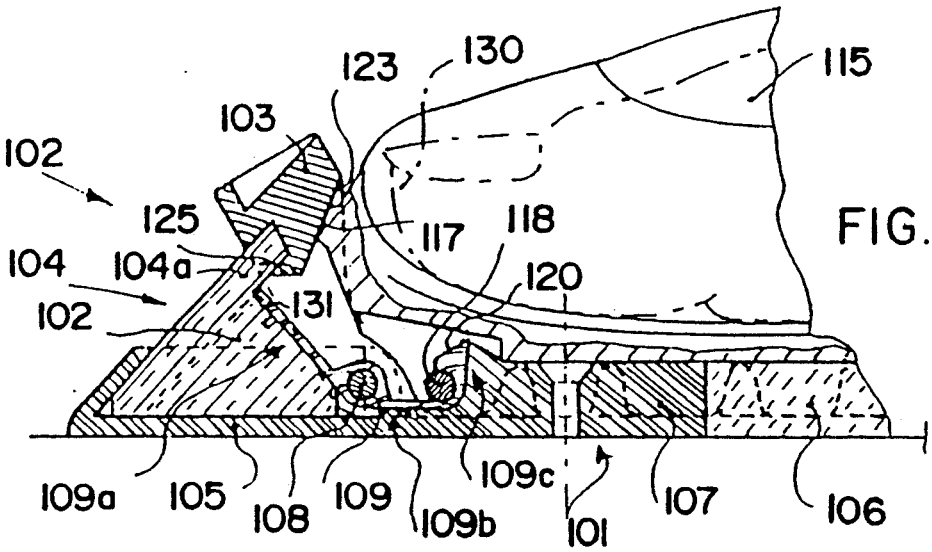
FIG. 13 is a longitudinal cross-sectional view along 13—13 of FIG. 12.

The mode of operation of the apparatus according to the invention is made clear by first referring to FIG. 13 which is a cross-section taken along a line 13—13 of FIG. 12 when boot 115 rests flat on ski 101 in its operative or latched position in binding 102. The automatic insertion of the boot into the binding follows the same principles as described previously. That is to say, transverse shaft 118 is supported on ramp 120 as zone 117 of the toe of the boot contacts rear surface 123 of element 103. A downward displacement of the boot deforms upper portion 104*a* of elastic bumper 104 as shaft 118 slides forwardly down ramp 120. When it reaches the end of ramp 120, shaft 118 moves vertically downwardly into engagement with plate 109*b* where shaft 118 is aligned with the socket in hook 109*c*. The elastic bias on the boot exerted by portion 104*a* is directed towards the rear of the ski and causes shaft 118 to seat into the forwardly facing socket of hook 109*c*. Support zone 117 of the boot is biased by a force directed from front to rear of the ski parallel to the upper surface of the ski and transmitted by the rear surface of abutment 123. This forces results from the elastic deformation of portion 104*a* of the bumper which, when such portion recovers, delivers a predetermined quantity of energy to the system. Because this quantity of energy is derived from the compression of only a small portion of the total volume of the elastic system, latching of the boot to the ski is easy to carry out and does not require a substantial expenditure of energy on the part of the skier.

FIG. 13 demonstrates that the axis of rotation 108 of intermediate journalled element 109 functions as the journal axis of boot 115 with respect to ski 101 after the heel of the boot is initially lifted from the ski. Axis 108 is positioned forwardly of a vertical plane passing through the front end of toes 130 of the wearer. This characteristic makes it possible to obtain an angular rotational displacement of boot 115 on the ski greater than is obtained from the first two embodiments described above. Binding 102, therefore, is better adapted to the technique of "alternate steps" in skiing. Axis 108, even though it is forwardly offset with respect to the front ends of toes 130, is not offset to such an extent as to adversely affect an important result achieved in the present invention, namely the provision of excellent sensation of the reactions of the ski, and consequently the ability of the skier to easily guide the ski.

FIG. 14 shows a cross-section of the boot shown in FIG. 13, but showing boot 115 rotated on the ski so that the heel of the boot is elevated. As the user begins to lift his heel from the position shown in FIG. 13, the boot initially pivots about an axis defined by transverse shaft 118 as front support zone 117 slides on rear abutment surface 123 of element 103 and the latter begins to pivot about axis 108 against the resistance of portion 104*a* of upper 104. Sliding movement occurs because surface 117 engaged with rear surface 123 on element 103 is pivotable about axis the axis of shaft 118, while surface 123 is pivotable about axis 108 which is displaced from the axis of shaft 118. This differential pivoting of boot 115 about the axis of shaft 118, and of such axis about axis 108, continues until notch 125 on element 103 engages tongue 131 on plate 109*a* of element 109. When this occurs, further pivotal movement of the boot imparts rotation to element 109 and the boot thus begins to pivot only about the axis of pin 110, namely rotation axis 108. The rotation of portion 109*a* compresses portion 104*b* of the elastic bumper. Consequently, the third embodiment of the invention utilizes a two-stage resilient system in which the resistance to pivotal movement of the boot on the ski is discontinuous. That is to say, the rate of change of resistance increases at a relatively low rate when the heel of the boot is initially lifted from the ski storing energy in portion 104*a* of the bumper. After the heel has been lifted a predetermined amount, further lifting of the heel causes the rate of change of resistance to increase as energy is stored in portion 104*b* of the bumper. The elastic bias opposing the lifting of the heel of the boot from the ski thus increases monotonically but is discontinuous providing a two-stage type of spring action on the boot.

As a consequence of the process described above, the effort required of a skier is relatively low in the initial stage of pivoting, and increases with increases in the extent of rotation of boot 115. This minimizes the physical effort of the skier during use of the ski. The energy stored in elastic buffer 104 by reason of its deformation is restored to the system in the form of a return couple applied to boot 115 which urges the boot to a position flat on ski 101.

The operation by which the boot is removed from the binding involves pivoting movable abutment 103, for example using the tip of the ski pole in cavity 112. Because only a small volume of elastic material, namely portion 104*a*, must be compressed during this operation to effect unseating of pin 118 from the socket in the binding, removal of the boot is facilitated.

While journalled intermediate element 109 constitutes an important characteristic of this embodiment, other equivalent structures will be apparent to those skilled in the art.

Figure 16:
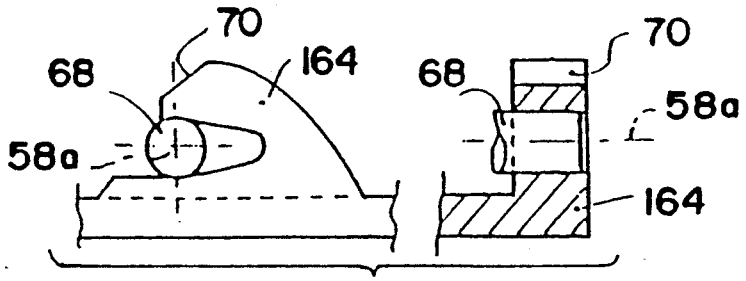
FIG. 16 is a lateral view and a transverse cross-section view of an alternate construction of latching means for the second embodiment of the invention.
Figure 17:
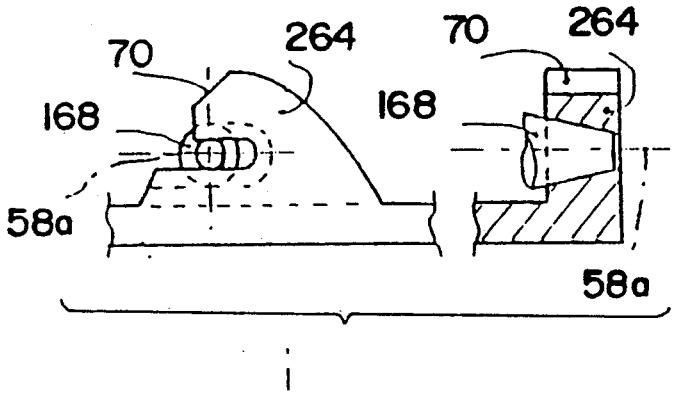
FIG. 17 is a lateral view and a cross-sectional view of an alternate construction of the latching means shown in FIG. 16.

An alternative construction for the latching means for the second embodiment is shown in FIGS. 16 and 17 to which reference is now made. FIG. 16 shows a portion of pin 68 that projects laterally from the toe member of boot 65 shown in FIG. 10. Pin 68 is in the form of a metallic cylinder whose axis is designated by reference number 58*a*, and whose diameter is such that the axial ends of pin 68 can fit within forwardly open elongated slot defined by laterally spaced hooks 164 located in the upturned lateral side edges of base 55. The characteristic of hook 164 is that the vertical height of the slot it defines is a function of the length of the slot. That is to say, the open end of the slot is substantially equal to or just greater than the diameter of pin 68; but the height of the slot decreases progressively towards the rear thereof. Thus, pin 68 easily snaps into the slot.

The forward end of each hook 164 defines ramp 70 which is engageable by pin 68 during the automatic insertion of the boot into the binding as described previously. This modification of the complementary latching means on the binding is advantageous because it reduces horizontal and vertical play between boot 65 and binding 52.

FIG. 17 is an alternative construction of the arrangement shown in FIG. 16 which shows a cylindrical pin. In FIG. 17, each pin 168 of boot 65 has a truncated conical shape, the major diameter being adjacent the boot, and the minor diameter being on the free end of the pin. Pin 168 seats in a complementary shaped slot located at the forward end of open hook 264 on the base of the binding. Axis 58*a* of truncated conical projections 168 establishes the rotational axis of the boot with respect to the ski. The top surface of hook 264 defines ramp 70 for facilitating automatic insertion of the boot into the binding. This matching of boot 65 and the complementary latching means 264 of binding 52 offers advantages identical to those of the embodiments of FIG. 16.

Figure 18:
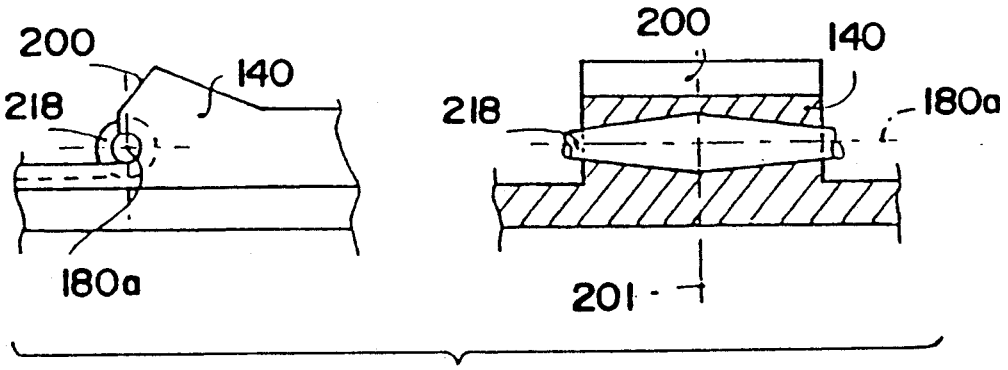
FIG. 18 is a lateral view and a transverse cross-section view of an alternate construction of the boot/binding latching means of the first embodiment of the invention.

In order to reduce horizontal and vertical play between the boot and the binding in the first and third embodiments of the invention, the modification shown in FIG. 18 can be employed. In FIG. 18, transverse shaft 218 for either of boots 15 or 115 has a frusto-conical, or bitruncated conical shape, i.e., its longitudinal plane of symmetry 201, which is a median plane parallel to and midway between the legs in which the shaft is mounted, defines two truncated symmetrical sections each having a truncated conical shape. The larger diameter of each shape lies in plane 201; and the smaller diameter of each shape lies at edges 19 or 19' of boot 15, or edges 119, 119, of boot 115'. The axis of transverse shaft 218 of the boot coincides with axis 180*a* of rotation of the boot with respect to the ski. Shaft 218 fits in a seat of complementary shape in forwardly open hook 140 on the base; and the upper portion of hook 140 defines ramp 200 for facilitating automatic insertion of the boot into the binding.

Figure 19:
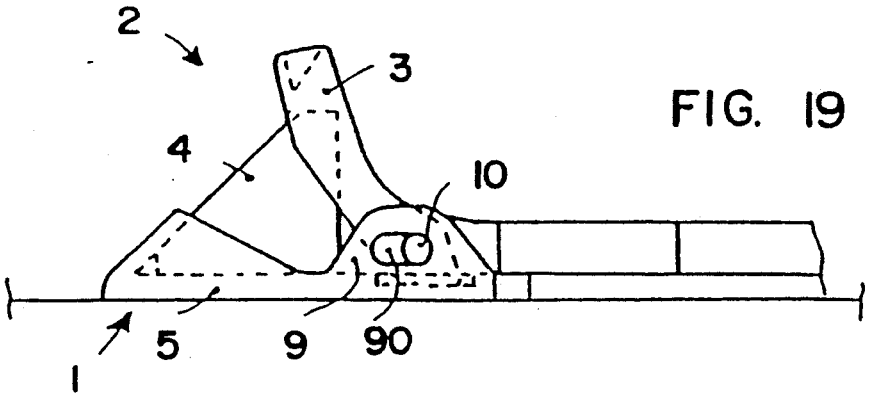
FIG. 19 is a lateral view of a fourth embodiment of the invention.

FIG. 19 is a side view of a fourth embodiment of the invention, and represents a modification of binding 2 of the first embodiment illustrated in FIGS. 1-7. Movable abutment element 3 is journalled in base 5 by means of pivot shaft 10 that fits in a longitudinally extending slot 90 in mounting lug 9 of base 5. Slot 90 allows limited translation of element 3 in response to relative movement of frontal support zone 17 on nose 16 of the boot, which bears against rear surface 23 of element 3 as the boot rotates about axis 8*a* of pin 18.

As the heel of the boot is lifted from the ski, nose 16 on the boot engaged with element 3 forwardly displaces the element without rotating it as shaft 10 slides forwardly in slot 90 and bumper 4 is deformed. Eventually, shaft 10 abuts the forward end of the slot. At this point, axis 8 about which element 3 is pivotal on the binding is located forwardly of axis 8*a* of pin 18 about which the boot pivots on the binding. Further rotation of the boot about axis 8*a* imparts rotation to element 3 about axis 8. The torque exerted by bumper 4 on the boot after the start of rotation of element 3 is increased over that exerted by the bumper during translation of the element. Thus, the resistance to lifting the heel of a boot from the ski experienced by the skier is less during initial rotation of the boot from a flat position on the ski than during rotation of the boot through larger angles of inclination. This situation arises because the lever arm of the moment generated by the engagement of the boot with the binding is greater when axis 8 and 8*a* are displaced than when these axes are coincident.

Relative sliding of movable abutment element 3 also occurs as the boot returns to a flat position on the ski. The result obtained is a substantial shock absorption action during the return of the boot to a flat position. This represents an advantage for the skier because the return movement of the boot is less violent, and consequently less stressful to the foot of the skier permitting the skier to more easily maintain a desired course. Thus, the fourth embodiment performs in a manner that emulates the performance of the third embodiment so far as providing a differential spring load on the boot.

The second embodiment of the invention shown in FIGS. 8-10 can be modified in the manner described above. In such cases, uprights 84, 85 of mounting 59 of binding 52 would be provided with longitudinally extending slots into which pivot pin 60 would be mounted.

FIG. 20 illustrates a lateral view of a binding and of a boot according to a fifth embodiment of the invention, and represents a modification of the first embodiment of the invention shown in FIGS. 1-7.

The elastic bias generated by elastic bumper 4 engaged by movable abutment element 3 is transferred to nose 16 of the boot by the engagement of rear surface 23 on element 3 by frontal support 17 of nose 16 of the boot. This bias latches boot 15 in binding 2 because the bias urges shaft 18 on the boot into mating engagement with the forwardly open socket in hook 9 as shown in the partial cut away in FIG. 20. Element 3 is journalled on shaft 10 carried in base 5 for pivotable movement about axis 8. Contrary to the first embodiment, however, axis 8 of element 3 is not coincident with axis 8*a* about which boot 15 is rotatable with respect to the ski. In this embodiment, the axis of the forwardly open socket in hook 9 is offset rearwardly of the axis of rotation of element 3. Preferably, the offset is of the order of about 1cm.

The technical consequences of the construction shown in FIG. 20 are similar to those ,obtained by the apparatus illustrated in FIG. 19. A similar modification of the second embodiment shown in FIGS. 8-10 is also possible.

FIG. 21 shows a sixth embodiment of the present invention wherein binding 520 for boot 650 comprises movable abutment element 530 mounted in cantilever fashion on elastic bumper 540 whose base is attached to cap 550*a* of base 500. Rear abutment surface 730 of movable abutment element 530 is in contact with frontal support zone 670 of the boot when the latter is in operative position on the ski, thereby effecting the transfer of bias from bumper 540 to nose 660 of the boot. The latching means of boot 650, i e., the two lateral projections 680 on nose 660 of the boot are seated in complementary sockets of the two forwardly opened hooks 640 on base 550. Element 530 is thus not fixedly pivoted to the base as in the previously described embodiments. This connection to the base confers mobility to the movable abutment element, and is applicable to the first embodiment as well as to the second embodiment of the invention.

Figure 22A:
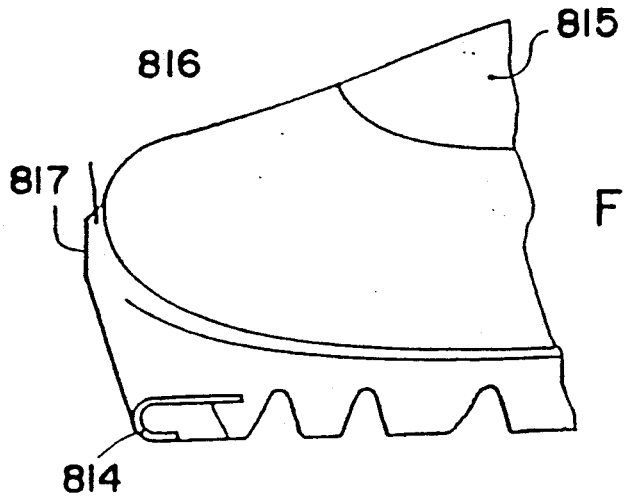
FIGS. 22*a* and 22*b*, respectively, are a side view of alternative latching means for a boot, and an end sectional view of the complementary latching means therefore, according to a further embodiment of the invention.
Figure 22B:
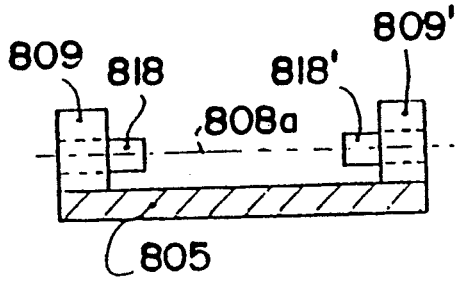

FIGS. 22*a* and 22*b* illustrate a modification of the second embodiment of the invention and show, respectively, a side view of the latching means of a boot, and an end view of the complimentary latching means of the binding. Boot 815 shown in FIG. 22*a* comprises, in a manner common to the invention, nose 816 having frontal support zone 817, and two rearwardly open sockets formed by hooks 814 which preferably are metallic and which are positioned symmetrically with respect to the median plane of the boot. The sockets in hooks 814 are adapted to cooperate with stubs 818 and 818' shown in FIG. 22*b*. Thus, the width of the socket in each of hooks 814 is substantially equal to the length of the stubs 818 and 818'. Each hook 814 is defined by a planar upper portion that is parallel to the plane defining the surface of the sole of the boot. The forward end portion of each hook 814 is in the form of semi-cylindrical surface opening towards the rear of the boot and being connected to a planar lower portion parallel to the upper portion but of lesser length. Thus, each socket in hook 814 defines a seat for one of stubs 818 and 818'.

As shown in FIG. 22*b*, stubs 818 and 818' constitute complimentary latching means of the binding and each projects toward the center-line of the ski. These stubs are cylindrical in shape and have common axis 808*a* which is parallel to the upper surface of the ski and perpendicular to the longitudinal median plane. Axis 808*a* defines the axis of rotation of boot 818 with respect to the ski. The cylinders are fixed to uprights 809 and 809' integrally formed on base 805 of the binding. The mode of operation of apparatus comprising complementary latching means 814, 818 and 818' is identical to that which has been described previously.

Figure 23A:
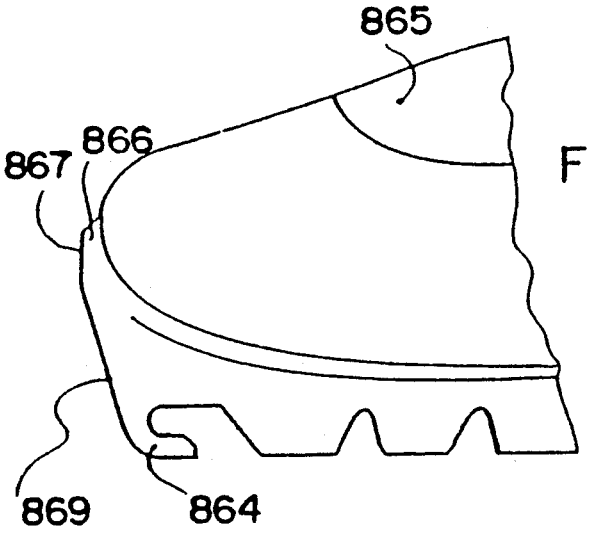
FIGS. 23*a* and 23*b*, respectively, are a side view of alternative latching means for or boot, and an end sectional view of the complementary latching means therefor according to a further embodiment of the invention.
Figure 23B:
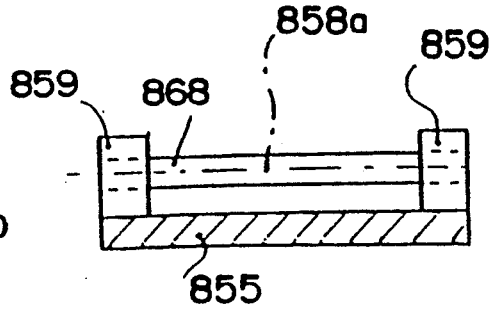

FIG. 23*a* and 23*b* illustrate a modification of the first first embodiment of the invention and show, respectively, a side view of the latching means of a boot, and an end view of the complementary latching means of the binding. Boot 865 shown in FIG. 23*a* comprises elements common to the apparatus according to the invention, namely nose 866, frontal support zone 867, and two spaced lateral edges 869 which are similar to edges 69, 69, of the first embodiment, and which define a median opening (not shown). In each lateral edge 869 is hook 864 that defines a rearward facing socket, the sockets in edges 869 being symmetrical with respect to the longitudinal median plane of boot 865. Each socket comprises a planar upper portion parallel to the plane defining the sole of the boot. The forward end portion of each socket in hook 864 is in the form of a semi-cylindrical surface opening towards the rear of the boot and being connected to a planar lower portion parallel to the upper portion but of lesser length. Thus, the sockets in hook 864 constitute latching means that can complimentarily engage latching means on the binding when the boot is in operative position relative to the binding.

Transfer shaft 868 shown in FIG. 23*b* constitutes the latching means of the binding and is in the form of a cylindrical shaft having axis 858*a* which is the axis of rotation of boot 865 with respect to the ski. Axis 858*a* is parallel to the upper surface of the ski and perpendicular to the longitudinal median plane. At its ends, cylindrical shaft 868 is rigidly fixed to mounting 859 which constitutes the lateral edges of base 855. The mode of operation of the apparatus shown in FIGS. 23*a* and 23*b* is similar to the operation described above.

Figure 24:
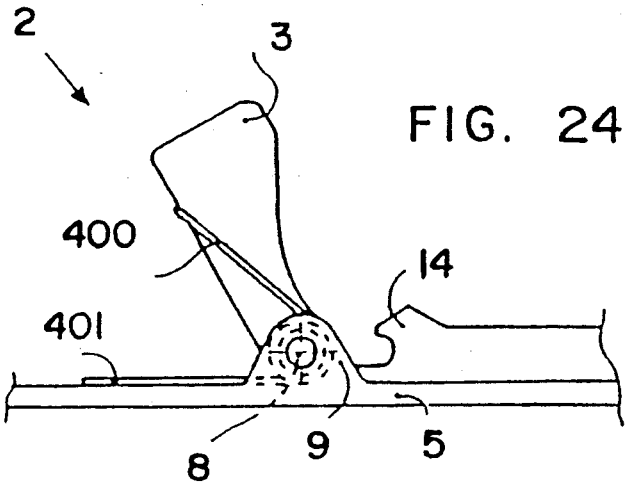
FIGS. 24 and 25 are schematic side views of alternative energization means of the apparatus according to the invention.
Figure 25:
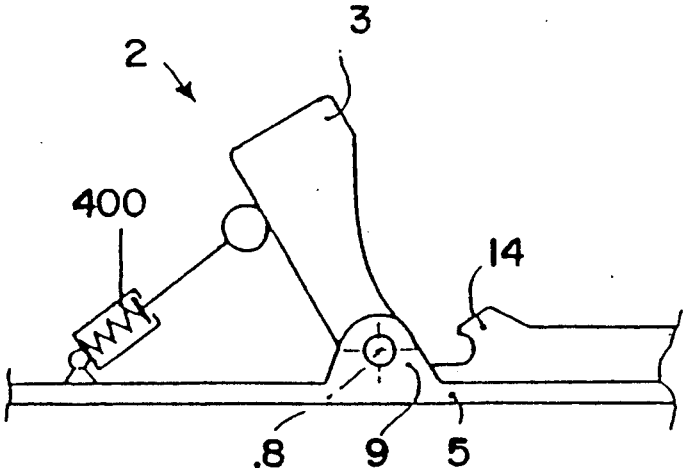

FIGS. 24 and 25 illustrate different schematic views of alternate energization means for the bindings of all of the previously described embodiments except that in FIG. 21. Binding 2 comprises base 5 having a forwardly opening socket in hook 14 and movable abutment element 3 pivotally mounted on lug 9 of base 5 for rotation about axis 8 with respect to the ski. Energization means 400, in FIG. 24, is a torsion spring in the form of single metallic wire 400 having opposite free ends 401 resting flat against the base and extending toward the rear of the ski to form one or more spirals around axis 8. The wire is engaged with the front surface of movable abutment element 3 by lodgment against the side of this element along a line running diagonally from bottom to top. The elasticity between arms 401 and the rest of the wire 400 provide the energy for operating binding 2.

The energization means shown in FIG. 25 is constituted by one or more compression springs 400A that replace bumper 4 in the first embodiment. Compression spring 400A is affixed to a piston whose free end engages element 3. The piston reciprocates in a chamber connected to the base plate of the base.

Under certain conditions of cross-country skiing, particularly in competition, it is essential that the boot does not, inadvertently, become released from the binding. Under such conditions of use, a reduction in the mass of the binding and the attendant reduction in weight, taken with mechanical simplicity and sturdy construction, become quite important. With these requirements in mind, the present invention also contemplates apparatus that assures an irreversible coupling of the boot to the ski. As used herein, the term "irreversible coupling" means that the boot remains coupled to the ski only as to involuntary acts such as occur in operational use of the ski.

Figure 30:
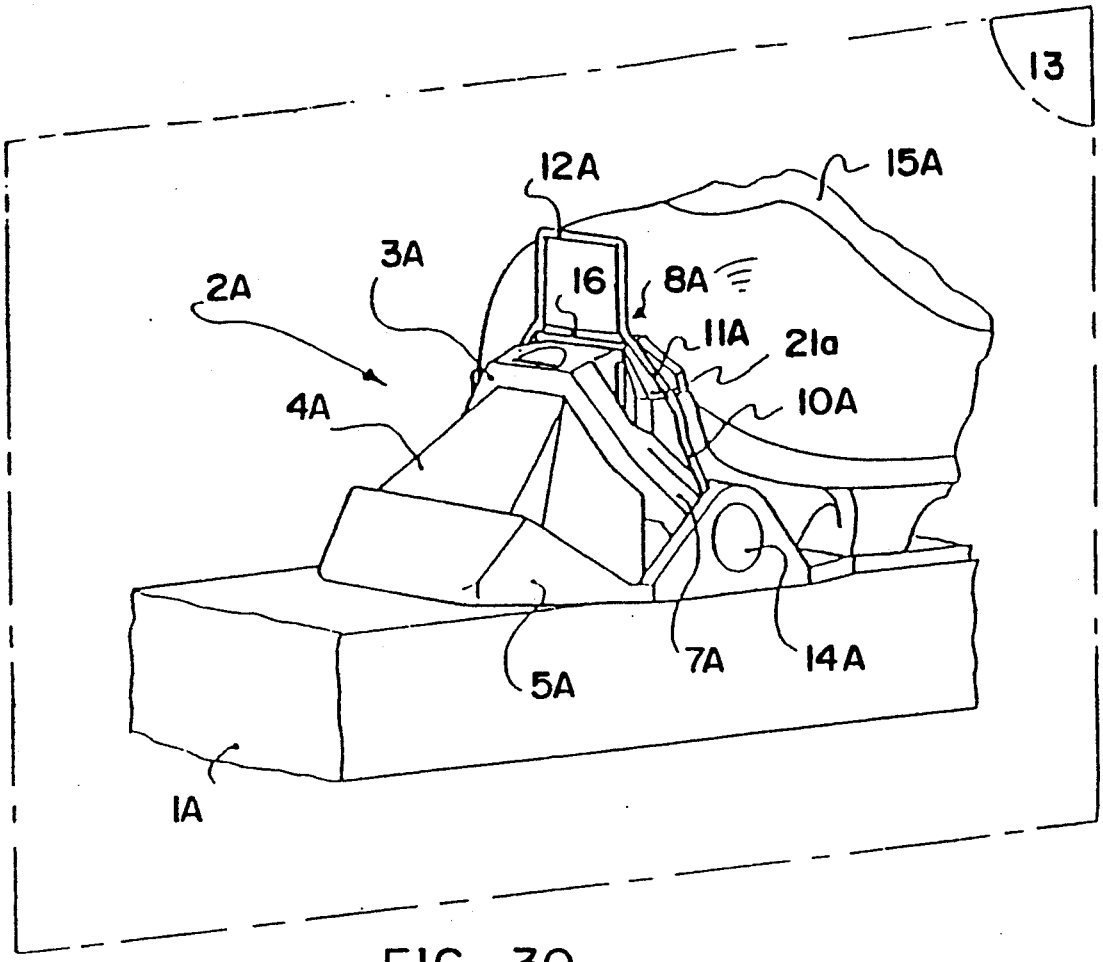
FIG. 30 is a front perspective view of the assembly of the binding member and toe member according to the present invention of the apparatus shown in FIG. 26 for the purpose of showing the supplemental latching means in its operative position.

In FIGS. 26, 28 and 30, binding 2A is a modification of the invention which provides supplemental, manually operable latching means for retaining a boot to a binding against accidental release. The binding comprises base 5A, elastic bumper 4A, movable abutment element 3A, and supplemental latching element 8A. Base 5A is constituted by a base plate, the front of which includes a cap configured to receive the front corner of elastic bumper 4A. The base plate may have counter-sunk holes for receiving screws for attaching the binding to ski 1A.

Base 5A also includes centrally located hook 29A defining a forwardly open socket that constitutes the latching means of the binding. The top of hook 29A extends rearwardly to form lateral guide rib 40A for boot 15A on ski 1A. Guide rib 40A has a length that is purely exemplary in the drawings. It may be bonded or otherwise attached to lateral guide rib 41A, which may be integral with ski 1A, or which may be a separate element attached to the ski. The rectangular cross-section of ribs 40A and 41A shown in the drawings is exemplary only, and other shapes are possible.

Movable abutment element 3A is pivotably mounted to base 5A on laterally spaced lugs 6A, 6A' which extend vertically from the base plate. Each of these lugs contains transverse cylindrical bores 14AA and 14AA' whose common axes define the boot axis, which is also referred to as the axis of rotation 30A of movable abutment element 3A on the ski. The diameters of bores 14AA and 14AA' are somewhat greater than the diameters of pins 14A and 14A' on element 3A so that the pins are freely rotatable about axis 30A.

Bores 14AA and 14AA' are formed in the front portion of lug 6A, 6A' which have exterior relief portions forming seats that engage the lower ends of arms 7A and 7A' of movable abutment element 3A for limiting rearward movement (i.e., clockwise as seen in FIG. 26) of the movable element.

FIG. 28 illustrates a longitudinal cross-sectional view taken along median plane 13 of binding 2A. The partial cylindrical socket or seat defined by hook 29A opens towards the front of the ski and has an axis which is coincident with the axis of rotation 30A of movable element 3A. The socket defined by hook 29A serves as a pivotal support for cylindrical transverse shaft 18A of boot 15A. The axis of rotation of boot 15A with respect to ski 1A is common to axis 30A of element 3A. As a consequence of this construction, no longitudinal displacement takes place between nose 6A of boot 15A and the rear surface of movable abutment 3A when the heel of the boot is lifted from the ski.

Figure 29:
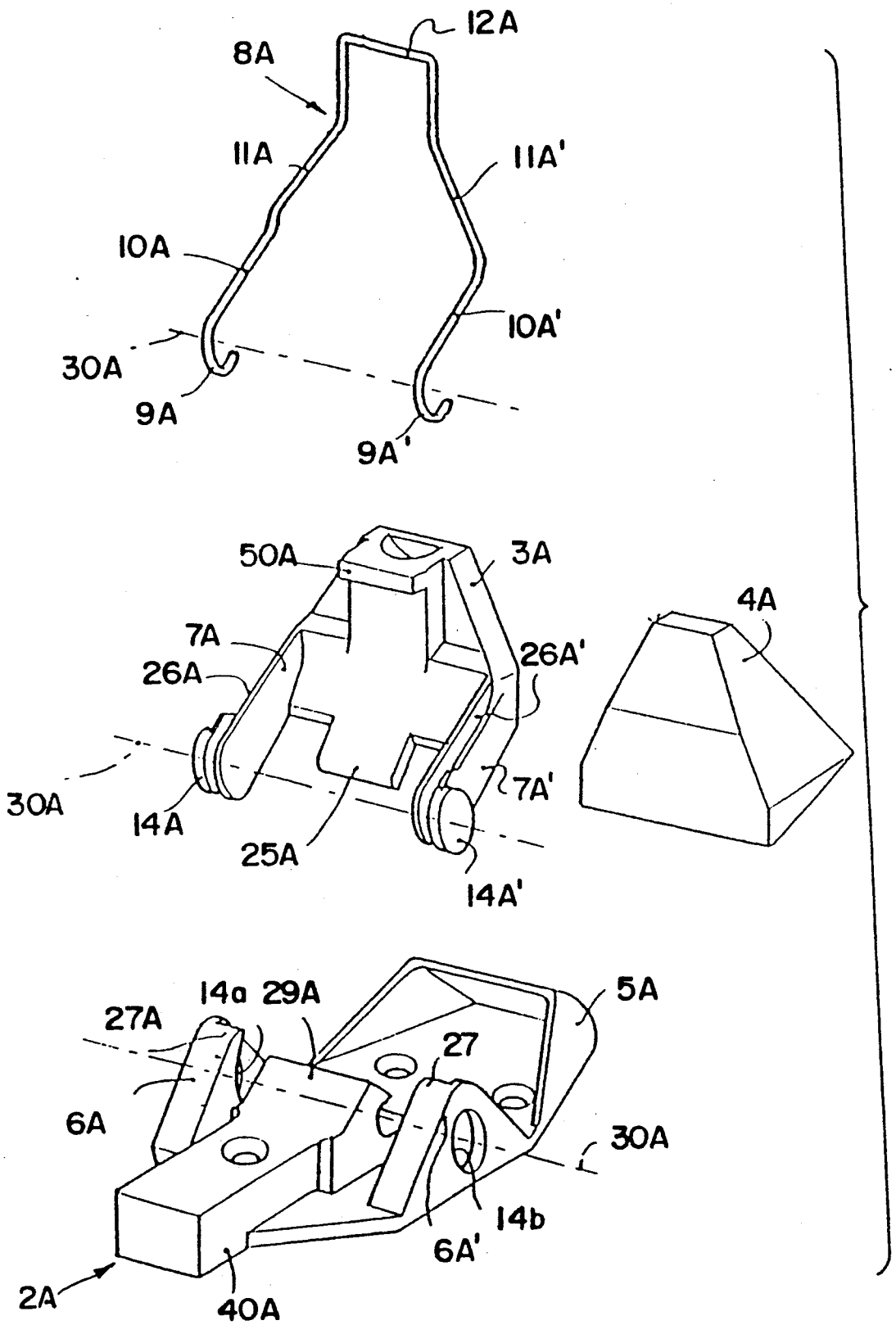
FIG. 29 is an exploded perspective rear view of the binding member shown in FIG. 26.

Abutment element 3A, as shown in FIGS. 26, 28 and 29, has a general inverted U-shape whose two lateral arms are constituted by arms 7A and 7A' on whose ends are cylindrical pins 14A and 14A'. The rear surface of element 3A has on its lower median portion, a beak or projection 25A directed toward the rear of the ski; and on its upper median portion, projecting lip 50A for contacting the top of frontal support surface 17A of nose 16A of the toe member of the boot by reason of the bias of elastic bumper 4A. The upper portion of movable abutment element 3A permits the abutment to be manually manipulated to remove boot 15*a* from the binding; and the front surface of movable abutment 3A is in contact with elastic bumper 4A.

Cylindrical pins 14A and 14A' engaged in lower ends of arms 7A and 7A' of element 3A are directed outwardly from the median plane of the ski. These pins constitute axles which engage in bores 14AA and 14AA' in base 5A to effect pivotal movement of element 3A on the ski around axis 30. Axis 30 is shown parallel to the upper surface of the ski, and perpendicular to the longitudinal median plane of the ski, but other angular configurations are possible. The length of each cylindrical pin 14A and 14A' is substantially the same as the length of bores 14A and 14AA' in the lugs of the binding. The lower ends of arms 7A and 7A' are rotatable in cut-outs provided in the front portions of lugs 6A and 6A'. The upper portions of arms 7A and 7A' of element 3A are provided with at least two grooves 26A and 26A' which extend longitudinally along the arms from top to bottom towards the rear of the ski to describe, at the level of the lower ends, an incomplete surface of revolution. The surface of revolution is concentric with the axis of pins 14A and 14A' as illustrated in FIG. 1.

Binding 2A also includes supplemental latching element 8A that constitutes elastic, manually operable latching means for holding boot 15A on the ski. The non-operational position of element 8A is shown in FIGS. 26 and 28; and the operational or latched position is shown in FIG. 30.

In the exploded perspective view of FIG. 29, element 8A has the form of a single metallic wire shaped to conform to the rear surfaces of element 3A except as to manipulation portion 12 which forms a bail on the inverted U-shape. The upper median rectilinear part of portion 12A is substantially parallel to, but elevated above, the upper median portion of abutment element 3A.

Element 8A is symmetrical about the longitudinal plane of the ski, and has at least two lower ends which are constituted by forwardly open hooks 9A and 9A'. Each of these hooks is obtained by deforming the wire of element 8 at its ends thus giving to these ends the form of an incomplete circle. The partial circles of hooks 9A and 9A' are concentric with the partial circle formed by the lower ends of grooves 26A and 26A', and the diameter of hooks 9A and 9A' is such that the elastic wire is rotatable about common axis 30A on abutment element 3A.

In order for element 8A to rotate when boot 15A is engaged in binding 2A' the inner surface of grooves 26A and 26A' are shaped in the form of a semi-circle whose circumference is greater than the partial circle constituted by hooks 9A and 9A' which are forwardly open. Reference is made of FIG. 1 to illustrate these characteristics.

Forward pivoting of element 8A is limited by its engagement with abutment element 3A; and rearward pivoting is limited by abutments 27A and 27A' forming the tops of lugs 6A and 6A'. These abutments also serve to limit rearward rotation of element 3A when boot 15A is not engaged in the binding.

FIG. 4 shows element 8A having at least two portions 10A and 10A' which are seatable in grooves 26A and 26A' of movable abutment element 3A. The upper ends of portions of 10A and 10A' are connected to portions 11A and 11A' that converge, from bottom to top, towards longitudinal median plane 13. The upper ends of portions 11A and 11A' join to form manipulation element 12 which projects above the upper portion of element 3A.

Portions 11A and 11A' are adapted to cooperate directly with nose 16A of boot 15A after elastically spreading of portions 11A', 11A' to become attached to the boot following the manual latching of the boot to the ski. Element 8A is shown and described above as being metallic, but this element may be formed of any appropriate elastic material.

Toe member or nose 16A of boot 15A, as shown in FIG. 27, includes frontal support zone 17A which serves as a localized surface for transmitting energy from complementary latching means 18A, 29A by which the boot is attached to the ski, and later for transmitting return energy to the boot as it is returned to a flat position on the ski subsequent to the lifting of the heel of the boot. The energy source results from the compression of the elastic bumper when the heel is lifted from the ski.

Nose 16A of boot 15A likewise comprises lateral separate edges **19*a* and 19*b* which serve to mount transverse shaft 18A of the boot which constitutes the latching means of the boot member. Frontal support zone 17A is a generally planar and substantially vertical surface centrally located between two lateral projections having surfaces facing the exterior sides of the boot. Such surfaces are in the form of ramps 21*a* and 21*b* containing grooves 20*a* and 20*b*. These ramps are engaged by portions 11A and 11A' of element 8A and serve to elastically deform such portions by laterally spreading them. Grooves 20*a* and 20*b* are situated directly beyond ramps 21*a* and 21*b* so that during a manual latching operation, portions 11A and 11A' are deformed by ramps 21*a* and 21*b* from their initial, or unstressed configuration, and snap into grooves 20*a* and 20*b*. The two anchorage zones of element 8A on toe portion 16A** of the boot results in a secure latching of the boot to the ski. While two anchorage zones are shown and described above, it is obvious that the manual latching means could be modified by using only a single anchorage zone or, alternatively, more than two anchorage zones.

Referring to FIG. 30 in which the boot is mounted in the binding, it can be seen that the boot is connected to ski 1A in two separate ways: cooperation of latching means 29A in the binding with latching means 18A in the book; and manual latching means 8A in cooperation with nose 16A of the boot.

As shown in the drawings, element 8A passes from an unlatched position, in which its portions 10A and 10A' rest on the upper portion of grooves 26A and 26A' (see FIGS. 26 and 28) to a latched position reached by rotation of element 8A about axis 30A in which elastically deformable portions 11A and 11A' are seated in grooves **20*a* and 20*b* of nose 16A**.

The manual latching operation occurs in the manner described below. First, the boot is connected by its front end 16A to the ski by means of binding 2A according to the technique described above in connection with the first embodiment of the invention. Then, the skier grips manipulation portion 12A of element 8A, and rotates the wire from front to rear. Portions 9A and 9A' on the wire, guided by lower portions of grooves 26A and 26A', pivot until portions 11A and 11A' of the elastic wire engage the lower zones of ramps **21*a* and 21*b* on the nose of the boot. As portions 11A and 11A' pass over the ramps, they are elastically deformed form their unstressed position in a direction normal to longitudinal plane 13 of the ski. After the maximum level of ramps 21*a* and 21*b* is crossed by portions 11A and 11A', the elasticity of the wire that constitutes element 8A effects movement of portions 11A and 11A' towards their unstressed position thus seating these portions in grooves 20*a* and 20*b*. Supplemental manual safety latching is thus completed. As to the unlatching operation, it is performed by rotating wire 8 from rear to front to unseat portions 11A and 11A' from groves 20a and 20b**.

The front surface of each groove 20a and 20b has a slope greater than that of latching ramps 21a and 21b. The sliding of element 8A on the front surface of grooves 20a and 20b thus requires the manual application of a predetermined level of force to element 8A. This excludes the possibility of involuntary activation of wire 8A and/or movable abutment 3A. Thus, this construction precludes accidental release of the boot from the binding in the course of cross-country skiing. As a result, maximum security for the latching of the boot on the ski is achieved.

Element 8A, in its operational position shown in FIG. 30, does not interfere with pivotal movement of the boot with respect to the ski because the element is connected to nose !6A, which abuts and does not move relative to element 3A. The assembly is thus rotatable as a unit around axis 30A to compress elastic bumper 4A. Furthermore, in its nonoperational position, element 8A rests in grooves 26A and 26A' on member 3A. In such case, the boot is connected to the ski in the manner described in connection with the first embodiment of the invention and element 8A remains disengaged from nose 16A but moves with the nose and element 8 in response to lifting of the heel from the ski, and its return to a flat position on the ski. Thus, element 8A constitutes manual latching means that is optionally available to supplement the complementary latching means 29 on the binding member and latching means 18 on the boot member.

Figure 31:
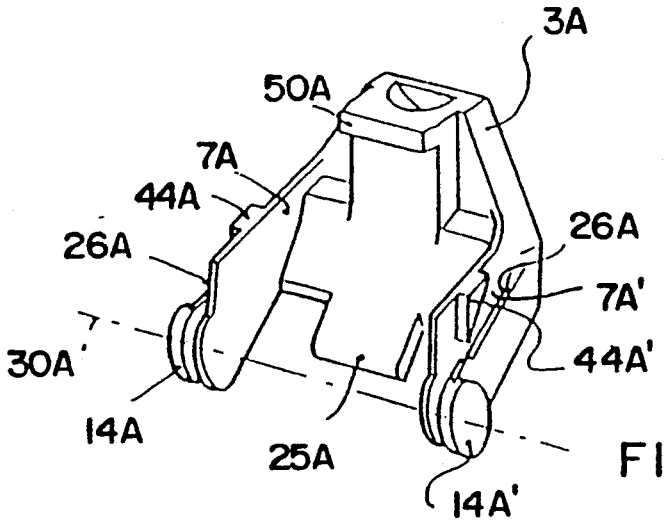
FIG. 31 is a rear perspective view of a modification of the movable abutment element as shown in FIG. 26.

FIG. 31 illustrates a modification of the movable abutment element 3A shown in FIGS. 26–30, the modification being identified by reference 3AA. Element 3AA, like element 3A has a general inverted U-shape with two arms 7A and 7A' provided with grooves 26A and 26A', and pins 14A and 14A'. The median portion of element 3A comprises rearwardly directed beak 25 cooperating with latching means 18A of the boot and latching means 29A of the boot, and lip 50A adapted to contact frontal support surface 17A of the boot. Each of arms 7AA and 7AA' includes element 44A and 44A' each of which is in the form of a body that projects from the vertical interior wall constituting the arms. Each element overlies grooves 26A and 26A' and thus serves as an abutment that limits rotation, from front to rear, of element 8A on movable abutment 3AA. The purpose of elements 44A and 44A' is to engage element 8A during frontward rotation of element 3A during removal of the boot from the binding and release element 8A from grooves 20a and 20b of nose 16 of the boot. Unlatching is thus achieved in a single manual operation by rotating element 3A forwardly. Such movement is directly imparted to element 8A.

The activation and the operational position of element 8A on nose 16A of the boot is the same as previously described. Elements 44A and 44A' provide a novel characteristic for automatically disconnecting the wire from the boot when element 3A is manually rotated by hand. The elastic wire of element 8A of the invention shown in FIGS. 26–31 can be used with any of the embodiments shown in FIGS. 1–25. Likewise, in a nonlatching limiting fashion, the elastic wire of element 8A is connected to abutment 3A, but this element can be linked to base 5, for example, in the manner disclosed in connection with the third embodiment, or in the embodiment shown in FIG. 19.

When using apparatus described above for cross-country skiing employing a technique referred to as "skating steps" or "skating", the maximum angular displacement of the boot with respect to the skis is usually in the range 20°–40°, and preferably is about 30°. When using the skating technique, it has been found that an optimum angle exists for pushing off. On the other hand, when using the "alternating step" technique in cross-country skiing, it has been found that the maximum angular displacement of the boot with respect to the ski is usually in the range 50°–70°, and preferably is about 60° for maximum efficacy. With knowledge of these aspects of the two usual cross-country skiing techniques, the problem is facilitating the required angular displacements in apparatus of the type described above, particularly with regard to the "alternating step" technique. Ideally, apparatus optimally designed for alternating steps also should be optimal for a cross-country binding of the "skating" type.

Figures 36A, 36B:
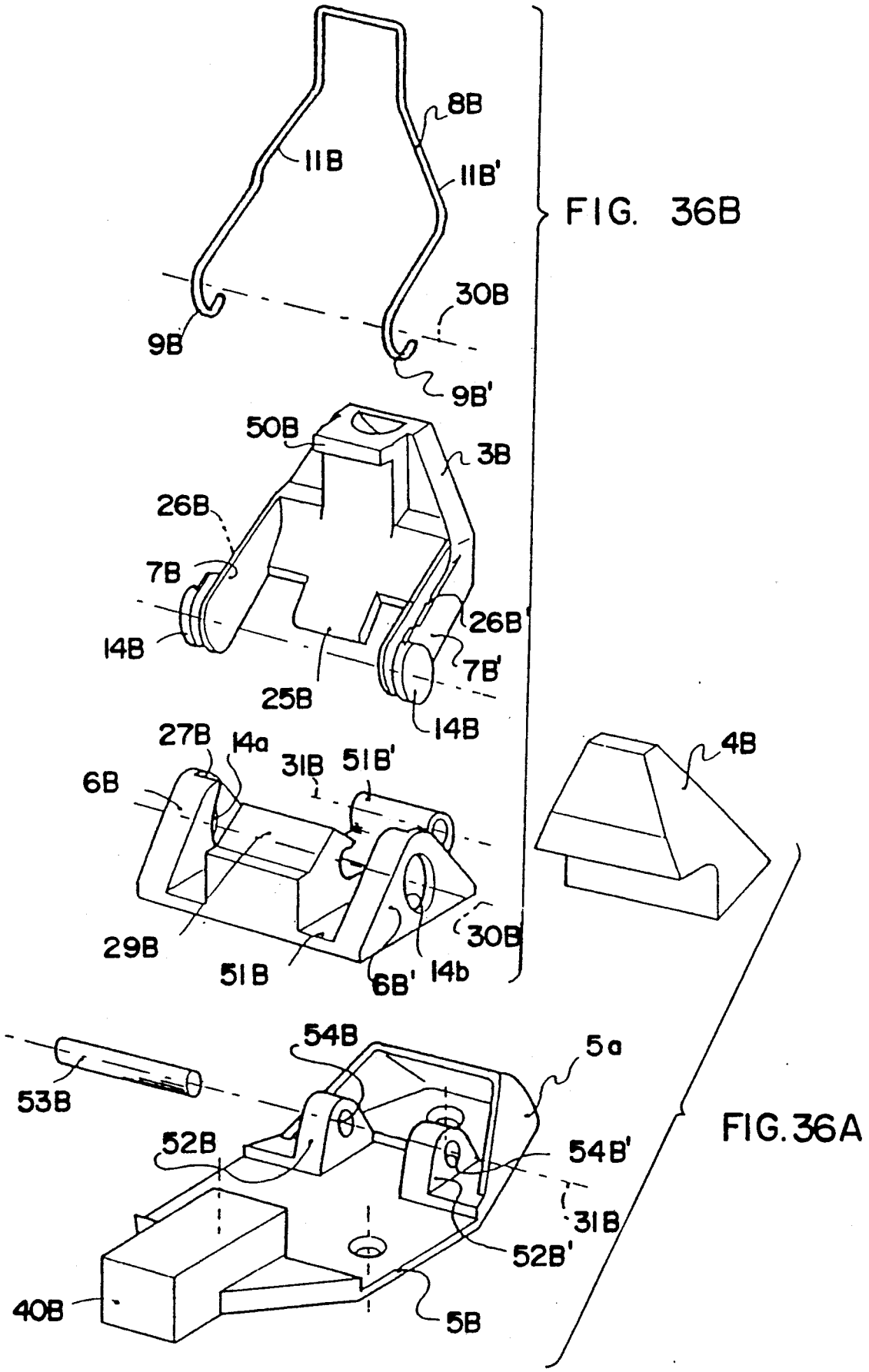
FIG. 36 is an exploded perspective rear view of the different elements constituting the binding of FIG. 32.

Apparatus according to the next described modification of the present invention is based on the same principles as described previously with respect to the latching means of the boot. FIGS. 32, 34 and 36 illustrate a modification of the binding shown in FIG. 26, such modification having a supplemental principle axis of rotation for the boot. Referring now to FIG. 32, binding 2B comprises moveable abutment element 3B mounted on lugs 6B and 6B' of base 5B for pivotal movement about axis 30B termed the element axis of the binding. Connected to element 3B, and also pivotal about axis 30B, is supplemental latching element 8B for manually latching toe member 16B of boot 15B to the ski. The configuration and operation element 8B are described in detail above.

The binding also includes elastic bumper 4B, which supplies energy to element 3B when the bumper is deformed. Unstressed, bumper 4B has a generally pyramidal shape, and is mounted in a socket between the front surface of element 3B and front cap 5a of base 5B. Finally, as shown in FIGS. 34 and 36, binding 2B includes subassembly A which is fixed to the ski, and subassembly B mounted on subassembly A for pivotal movement about a supplemental principle axis identified as subassembly axis 31B.

Subassembly B constitutes means that intervenes in the latching of the boot on the binding. Thus, subassembly B includes latching hook 29B containing a forwardly open semicylindrical socket, and two laterally spaced lugs 6B, 6B'. The front portions of each of these lugs includes a cut-out defined in its rear by abutment 27B, 27B'.

The forward portions of lugs 6B and 6B' have two bores, 14a and 14b, whose common axis defines axis 30B, the bores being symmetrical with respect to longitudinal median plane 13. Axis 30B is coincident with the axis of the semi-cylindrical socket in latching hook 29B.

Lugs 6B, and 6B' are carried by plate 51. In front of these lugs, plate 51 converges towards longitudinal median plane 13 to a forward end that terminates in cylindrically shaped transverse portion 51B, containing a transverse bore defining axis 31B.

Subassembly B also comprises U-shaped moveable abutment element 3B, which transmits latching and return energy as described above. The lower ends of arms 7B and 7B' of element 3B are provided with transverse pins 14B and 14B' directed transversely outwardly from the median plane of symmetry of the element. Pins 14B and 14B' pivotally fit in bores 14a and 14*b* of lugs 6B and 6B prime, and thus effect rotation of element 3B about element axis 30B.

Central projecting lip 50B on element 3B is adapted to contact the top of frontal support surface 17B of toe member 16B in order to transfer energy between the bumper and the boot. Projection 25B on element 3B is directed to the rear of the ski and limits forward displacement of transverse shaft 18B of boot 15B when the latter is in operative position in the binding.

Supplemental latching element 8B of this improvement is shown, in a non-limiting manner, in the form of a continuous elastic metal wire whose two free lower ends are constituted by forwardly open hooks 9B and 9B'. The lower ends of the wire seat in grooves 26B and 26B' of arms 7B and 7B', and are rotatable about axis 30B between two limits. One limit is established by abutments 27B and 27B' of lugs 6B and 6B'; and the other limit is established by the upper portions of grooves 26B and 26B' in the legs of element 3B.

Figure 35:
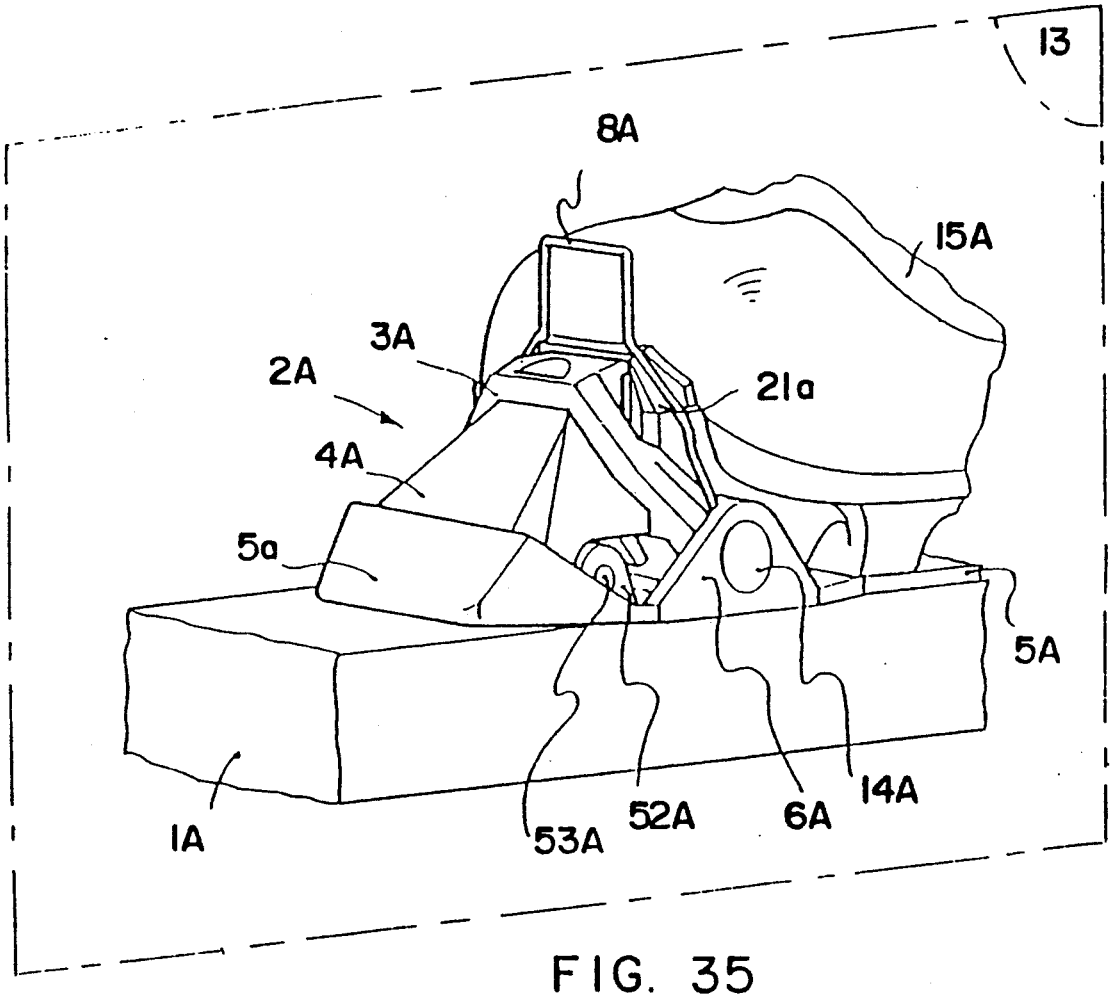
FIG. 35 is a front-perspective view of the boot of FIG. 33 mounted in the binding of FIG. 32, showing supplemental manual attaching means in operative position.

Element 8B may be moved manually to a latching position, at which a resilient portion of the wire engages nose 16B of boot 15B when complementary latching means 18B and 29B of the toe member and boot member respectively are in operative position. This condition is illustrated in FIG. 35.

Subassembly A comprises base plate 5B, which may contain countersunk holes by which the subassembly may be attached to a ski by suitable screws, for example. Plate 5B is relieved in its median portion to provide clearance for plate 51B and cylinder 51B' of subassembly B. The rear portion of base plate 5B is constituted by guide rib 40B which, in transverse cross-section, may be tetragonal, but is shown as being rectangular. Lateral guide rib 40B of binding 2B can be extended in a continuous fashion through guide rib 41B of identical shape. Rib 41B may be applied to the ski or may form an integral portion with the ski.

The front portion of subassembly A comprises fixed journal means for subassembly B. Such journal means are constituted by a pair of upturned longitudinally extending lugs 52B and 52B', containing transverse cylindrical bores defining subassembly axis 31B, which is shown, in a non-limiting fashion, as being transverse and perpendicular to longitudinal plane 13 of the ski (see FIG. 34). Cylindrical pivot pin 53B may be press-fitted in bores 54B and 54B', and passes through the axial aperture in cylinder 51B' of base 51 of subassembly B for rotatably mounting the latter on subassembly A. Cap 5*a* at the forward end of baseplate 5B is adapted to receive the lower front corner of elastic bumper 4B which constitutes the energization system of the apparatus. As can be seen in FIGS. 32 and 34, the rear surface of bumper 4B is supported against the front surface of element 3B.

FIG. 2 shows toe member 16B of the toe member of boot 15B which is configured like the front end of boot 15A described above. Toe member 16B is provided with frontal support surface 17 defining a local surface that transmits energy from and to the boot, the energy occurring during two operations. In the first, the movement of complementary latching means 18 and 29 into operative relationship develops latching energy effective to maintain the latching means in operative relationship. In the second operation, lifting the heel of the boot from the binding develops energy urging the heel of the boot to return to a flat position on the ski. In both cases, the energy source is derived from the deformation of elastic bumper 4B.

Front end 16B of the boot also includes a pair of laterally-spaced edges, 19*a* and 19*b* between which is mounted transverse shaft 18B which constitutes the latching means of the boot member. Surface 17B is a planar, approximately vertical surface located between two forwardly extending lateral projections on the exterior side of nose of the boot. The lateral edges of these projections are configured as ramps 21*a* and 21*b* containing grooves 20*a* and 20*b*. Ramps 21*a* and 21*b*, which cooperate with portions 11B and 11B' of the wire of element 8B, assure elastic deformation of such portions during manual movement of the wire to a latching position. Grooves 20*a* and 20*b* are situated rearwardly of ramps 20*a* and 21*b*; and as a consequence, portions 11B and 11B' of the wire snap back to their initial, unstressed condition when such portions enter the grooves. Thus anchorage zones are established which supplementally latch the boot to the binding in a secure way.

The cooperation between the boot and the binding occurs in a manner similar to that described in the previously described embodiments with respect to the automatic latching of the boot to the binding, and with respect to the manual latching as well. As shown in FIG. 35, boot 15B is removeably connected to binding 2 by the cooperation between transverse shaft 18B and the forwardly open socket in hook 29B as maintained by the resilient bias of bumper 4B acting through element 3B whose lip 50B bears against the top of bumper 4B while exerting a force, from front to rear, on the frontal support surface of the boot.

The rotational movement of the boot with respect to the ski effected by subassemblies A and B is a technical characteristic specific to this modification of the invention. As shown in the non-limiting example of FIGS. 32 and 34, the axis of rotation of element 3B on subassembly B, namely element axis 30B, and the axis of cylindrical transverse shaft 18B, namely the toe axis of the binding, are common. Thus, when the heel of the boot is initially lifted (see FIG. 34), the boot first rotates about element axis 30B, and simultaneously rotates element 3B of subassembly B on subassembly A which itself does not rotate about assembly axis 31B. In the first phase of pivotal movement of the boot on the ski, all rotation occurs about element axis 30B. Resistance energy delivered by the elastic bumper increases rapidly as the heel is lifted; and a point is eventually reached at which rotation of the boot about subassembly axis 31B is initiated. The boot, connected to subassembly B, begins to pivot around subassembly axis 31B, which is positioned forwardly of element axis 30B. Thus, the skier may obtain a maximum angular displacement of the boot on the order of 60° with respect to the upper surface of the ski. This can be seen in FIG. 34, the double rotation of the boot around axes 30B and 31B serves to very effectively compress elastic bumper 4, thus producing return energy for the boot. The maximum rotational development of the boot about axis 30 is limited by the upper portions of lugs 52B and 52B' which block further rotation of element 3B and limit rotation of the boot to a predetermined angle.

Positioning subassembly axis 31B forwardly of element axis 30B increases the length of the lever arm exerted by the boot on bumper 3B over the length if pivoting occurred only about axis 30B. Thus, the effort by a skier to rotate the boot on the ski is reduced using the apparatus of this aspect of the invention.

Alternatively, the axis of element 3B may be offset rearwardly relative to the definitional axis of transverse shaft 18B of the boot. Consequently, when the heel of the boot is lifted, interference occurs between the nose of the boot and abutment 3 due to the relationship between the rotational trajectories of the nose of the boot and the element 3B. In this case, the major portion of the rotation of the boot with respect to the ski occurs about axis 31B.

The energization means noted above, as well as all of the technical characteristics of the invention described in the present application, are cited by way of example only as preferred embodiments of the invention, and is clear that one of ordinary skill in the art can easily provide any technical combinations or equivalents without going beyond the scope of the invention. Finally, although the invention has been described with reference to particular means, materials, and embodiments, it should be understood that the invention is not limited to the particulars disclosed and extends to all equivalents within the scope of the appended claims.

We claim:

1. Apparatus for releasably attaching a toe member of a boot to a binding member on the upper surface of a ski having a longitudinal median plane comprising:

a) complementary latching means on said toe member and said binding member;

b) said toe member and said binding member being relatively movable in a longitudinal direction to an operative position at which the latch means complementarily engage each other;

c) a base for mounting on the upper surface of said ski;

d) an abutment element movably mounted on said base;

e) said abutment element adapted to engage said toe member when said toe member and said binding member are in operative position;

f) resilient means acting on said abutment element for resiliently maintaining said toe member and said binding member in operative position;

g) said abutment element being pivotably mounted on said base about an axis that is parallel to the upper surface of the ski and perpendicular to said median plane; and h) wherein said abutment element is U-shaped having a pair of spaced arms connected by a bar, each of said arms being journalled on said base for defining a boot pivot axis.

2. Apparatus according to claim 1 wherein said bar is notched for receiving the tip of a ski pole.

3. Apparatus according to claim 1 wherein the free ends of said arms engage the base to limit rearward pivotable movement of said stirrup.

4. Apparatus according to claim 3 wherein said arms are inclined forwardly at an acute angle with the top of the ski wherein said arms engage the base.

5. Apparatus according to claim 4 wherein the acute angle is approximately 60°.

6. Apparatus releasably attaching a toe member of a boot to a binding member on the upper surface of a ski having a longitudinal median plane comprising:

a) complementary latching means on said toe member and said binding member;

b) said toe member and said binding member being relatively movable in a longitudinal direction to an operative position at which the latch means complementarily engage each other;

c) a base for mounting on the upper surface of said ski;

d) an abutment element movably mounted on said base;

e) said abutment element adapted to engage said toe member when said toe member and said binding member are in operative position; and f) resilient means acting on said abutment element for resiliently maintaining said toe member and said binding member in operative position;

g) said abutment element being pivotably mounted on said base about an axis that is parallel to the upper surface of the ski and perpendicular to said median plane;

h) spring means mounted on said base, said abutment element including front and rear surfaces, said front surface being engaged with said spring means and said rear surface adapted to be engaged by a support zone on the toe member when the members are in operative position;

i) said spring means being in the form of an elastic bumper interposed between the base and said abutment element; and j) wherein said bumper is of rubber material.

7. Apparatus for releasably attaching a toe member of a boot to a binding member on the upper surface of a ski having a longitudinal median plane comprising:

a) complementary latching means on said toe member and said binding member;

b) said toe member and said binding member being relatively movable in a longitudinal direction to an operative position at which the latch means complementarily engage each other;

c) a base for mounting on the upper surface of said ski;

d) an abutment element movably mounted on said abutment element adapted to engage said toe member when said toe member and said binding member are in operative position;

f) resilient means acting on said abutment element for resiliently maintaining said members in operative position;

g) said abutment element being pivotably mounted on said base about an axis that is parallel to the upper surface of the ski and perpendicular to said median plane;

h) said latching means defining a common axis about which said toe member is pivotable relative to said ski when said toe member and said binding member are in operative position, said common axis being collinear with the axis about which said abutment element is pivotably mounted, and being adjacent the front of said boot member and located beneath the toes of a wearer of said boot member; and i) wherein the latching means on said toe member is in the form of pin means, and the latching means on said binding member is in the form of forwardly facing socket means.

8. Apparatus according to claim 1 wherein said pin means is in the form of a shaft extending between a pair of laterally spaced legs on said toe member, and said socket means is centrally located on the base.

9. Apparatus according to claim 8 wherein said shaft has a circular cross-section and said socket means is a socket that is semicylindrical in shape.

10. Apparatus according to claim 9 wherein said socket opens forwardly and has an axis perpendicular to the said median plane.

11. Apparatus according to claim 10 wherein said element includes a central projection directed toward the rear of the ski for forming an abutment for said shaft.

12. Apparatus according to claim 11 including means for limiting lateral displacement of the toe member relative to said binding.

13. Apparatus according to claim 7 wherein said pin means comprises a pair of shafts each of which extends laterally from said toe member, and said socket means comprises a pair of laterally spaced sockets in said base.

14. Apparatus according to claim 13 wherein each shaft has a circular cross-section and each socket has a semicircular cross-section.

15. Apparatus according to claim 14 wherein each socket opens forwardly and has an axis perpendicular to said median plane.

16. Apparatus according to claim 15 including means for limiting lateral displacement of the toe member relative to said binding member.

17. Apparatus for releasably attaching a toe member of a boot to a binding member on the upper surface of a ski having a longitudinal median plane comprising:

a) complementary latching means on said toe member and said binding member;

b) said toe member and said binding member being relatively movable in a longitudinal direction to an operative position at which the latch means complementarily engage each other;

c) a base for mounting on the upper surface of said ski;

d) an abutment element movably mounted on said base;

e) said abutment element adapted to engage said toe member and said binding member are in operative position;

f) resilient means acting on said abutment element for resiliently maintaining said toe member and said binding member in operative position;

g) said abutment element being pivotably mounted on said base about an axis that is parallel to the upper surface of the ski and perpendicular to said median plane; and h) wherein the latching means on said toe member includes a pin whose axis is perpendicular to said median plane and the latch means on said binding member includes a forwardly facing socket whose generatrix is perpendicular to said plane, said apparatus including ramp means on said binding cooperable with said pin for moving said toe member forwardly and downwardly in response to downward pressure of said pin on said ramp means until said pin is aligned with said socket, said movement of said toe member for resisting such movement until said pin is aligned with said socket, and thereafter effecting rearward movement of said toe member relative to said binding member until the pin seats in said socket and said members are in operative position.

18. Apparatus according to claim 8 wherein said shaft is a bitruncated conical shape that is symmetrical about a median plane parallel to and midway between said legs, and said socket means has a complementary shape for minimizing horizontal and vertical play between said toe member and said binding member.

19. Apparatus according to claim 13 wherein each shaft has a uniform circular cross-section, and each socket is formed by a longitudinal extending hook arm that defines a longitudinally extending forwardly opening slot for engaging said shaft when said toe member and said binding member are in operative position.

20. Apparatus according to claim 13 wherein each shaft is conically shaped, the major dimension of said shaft being adjacent said toe member, and each socket is complementarily shaped.

21. Apparatus according to claim 15 wherein said element is connected to said base only by being attached to said bumper whereby said element is mounted in cantilever fashion on said base.

22. Apparatus according to claim 1 including a manually operable elastic member in the form of a wire mounted on said binding member for rotation about said boot axis, said elastic member having a deformable portion engageable with said toe member for releasably maintaining said toe member and said boot member in operative position when said elastic member is in a latched position.

23. Apparatus according to claim 22 wherein said toe member has a notch, and said deformation portion on said elastic member seats in said notch when said elastic member is in latched position.

24. Apparatus according to claim 23 wherein the arms of said abutment element have aligned, transversely extending cylindrical pins that mate with complementary bores in said binding member, the axis of said pins coinciding with said boot axis.

25. Apparatus according to claim 24 wherein said elastic member is U-shaped and has free ends that are pivotally mounted on said cylindrical pins whereby the elastic member and the abutment element are rotatable about coincident axes that define said boot axis.

26. Apparatus according to claim 25 wherein said elastic element has opposite deformable portions that are symmetrically disposed relative to said median plane, and said toe member has opposite notches that are .symmetrically disposed relative to said median plane for seating said deformable portions when said elastic member is in a latched position.

27. Apparatus according to claim 26 wherein said toe member is provided with ramps adjacent to said notches for resiliently deforming said opposite deformable portions when said elastic member is moved to its latching position.

28. Apparatus according to claim 27 wherein the arms of said movable element include body elements overlying grooves in the arms thereof for limiting rotation of the elastic member in one direction relative to said elastic member.

* * * * *